US010286675B2

(12) United States Patent
Tsuchiya et al.

(10) Patent No.: US 10,286,675 B2
(45) Date of Patent: May 14, 2019

(54) RECORDING APPARATUS AND RECORDING METHOD

(71) Applicant: CANON KABUSHIKI KAISHA, Tokyo (JP)

(72) Inventors: Okinori Tsuchiya, Yokohama (JP); Akitoshi Yamada, Yokohama (JP); Junichi Nakagawa, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/803,611

(22) Filed: Nov. 3, 2017

(65) Prior Publication Data

US 2018/0134042 A1 May 17, 2018

(30) Foreign Application Priority Data

Nov. 11, 2016 (JP) ..... 2016-220856

(51) Int. Cl.
*B41J 2/51* (2006.01)
*B41J 2/175* (2006.01)

(52) U.S. Cl.
CPC ..... *B41J 2/17546* (2013.01); *B41J 2/17566* (2013.01); *B41J 2/51* (2013.01); *B41J 2002/17569* (2013.01)

(58) Field of Classification Search
None
See application file for complete search history.

(56) References Cited

U.S. PATENT DOCUMENTS 6,338,539 B1 * 1/2002 Kobayashi ..... B41J 2/16532 347/108
2008/0211169 A1 * 9/2008 Klein ..... B65H 3/0661 271/167

FOREIGN PATENT DOCUMENTS

JP 3495972 B2 2/2004

OTHER PUBLICATIONS

IP.com search.*
Wikipedia Article—"Black", retrieved on Aug. 3, 2018, Paragraph 1.*
Chromatic and Achromatic Colors| Mau Art & Design Glossary|Musashino Art University, retrieved on Aug. 4, 2018, p. 1.*
IP.com search (Year: 2018).*

* cited by examiner

*Primary Examiner* — Lisa Solomon
(74) *Attorney, Agent, or Firm* — Canon U.S.A., Inc. IP Division

(57) ABSTRACT

A recording apparatus acquires residual amounts of respective tanks and determines a recording area of one recording head and a recording area of another recording head from among the two recording heads based on the acquisition result, so as to reduce a difference between residual amounts of ink within the tanks corresponding to the respective recording heads.

21 Claims, 11 Drawing Sheets

RECORDING APPARATUS AND RECORDING METHOD

BACKGROUND

Field of the Disclosure

The present disclosure relates to a recording apparatus and a recording method for recording an image on a recording medium.

Description of the Related Art

An ink jet printer has become popular as an apparatus for recording print data such as a text image or a color image transmitted from a host computer, on a recording medium. An ink jet technique has been widely used for various purposes in addition to being used for a printer, or a copying machine. Therefore, there is an increased demand for a technique of executing ink jet recording at higher speed.

In the above-described ink jet printer, high-speed recording has been realized by primarily shortening recording time necessary for executing one time of scanning by widening a recording width recordable by one time of scanning or increasing a scanning speed. In addition to the above-described method of increasing a recording speed, Japanese Patent No. 3495972 discusses a method in which a plurality of recording units is arranged, and recording is executed by sharing a recording area with the recording units. The recording apparatus described in Japanese Patent No. 3495972 includes a left-side recording unit for recording a left-side recording area and a right-side recording unit for recording a right-side recording area. Then, ink tanks of respective colors of cyan, magenta, yellow, and black (CMYK) corresponding to the left-side recording unit and ink tanks of respective colors of C, M, Y, and K corresponding to the right-side recording unit different from the ink tanks of the left-side recording unit are mounted thereon.

As described above, the recording apparatus described in Japanese Patent No. 3495972 executes recording on a right-side area and a left-side area of a recording medium by using the respective recording units. Therefore, if ink of any one of ink tanks (i.e., respective four pieces, eight ink tanks in total) provided on the right-side and the left-side recording units is consumed, it is not possible to continue recording operation. Further, a user is not always in a condition where the user can replace the ink tank.

SUMMARY

The present disclosure is directed to a technique of increasing an amount of recording executable by using ink tanks mounted on a recording apparatus that executes shared recording processing by using a plurality of recording units.

According to an aspect of the present disclosure, a recording apparatus which executes recording on a first area of a recording medium conveyed in a conveyance direction by using a first recording unit having a group of recording elements for discharging ink stored in a first tank and executes recording on a second area of the recording medium different from the first area in a scanning direction by using a second recording unit having a group of recording elements for discharging ink stored in a second tank, which is arranged separately from the first recording unit by a predetermined distance in the scanning direction intersecting with the conveyance direction, the recording apparatus includes an acquisition unit configured to acquire first information about a residual amount of ink within the first tank and second information about a residual amount of ink within the second tank, a determination unit configured to determine a range of the first area and a range of the second area in the scanning direction based on the first information and the second information, and a control unit configured to control recording of an image based on a determination made by the determination unit.

Further features of the present disclosure will become apparent from the following description of exemplary embodiments with reference to the attached drawings.

DESCRIPTION OF THE EMBODIMENTS

Hereinafter, an exemplary embodiment of the present disclosure will be described with reference to the appended drawings.

Figure 1:
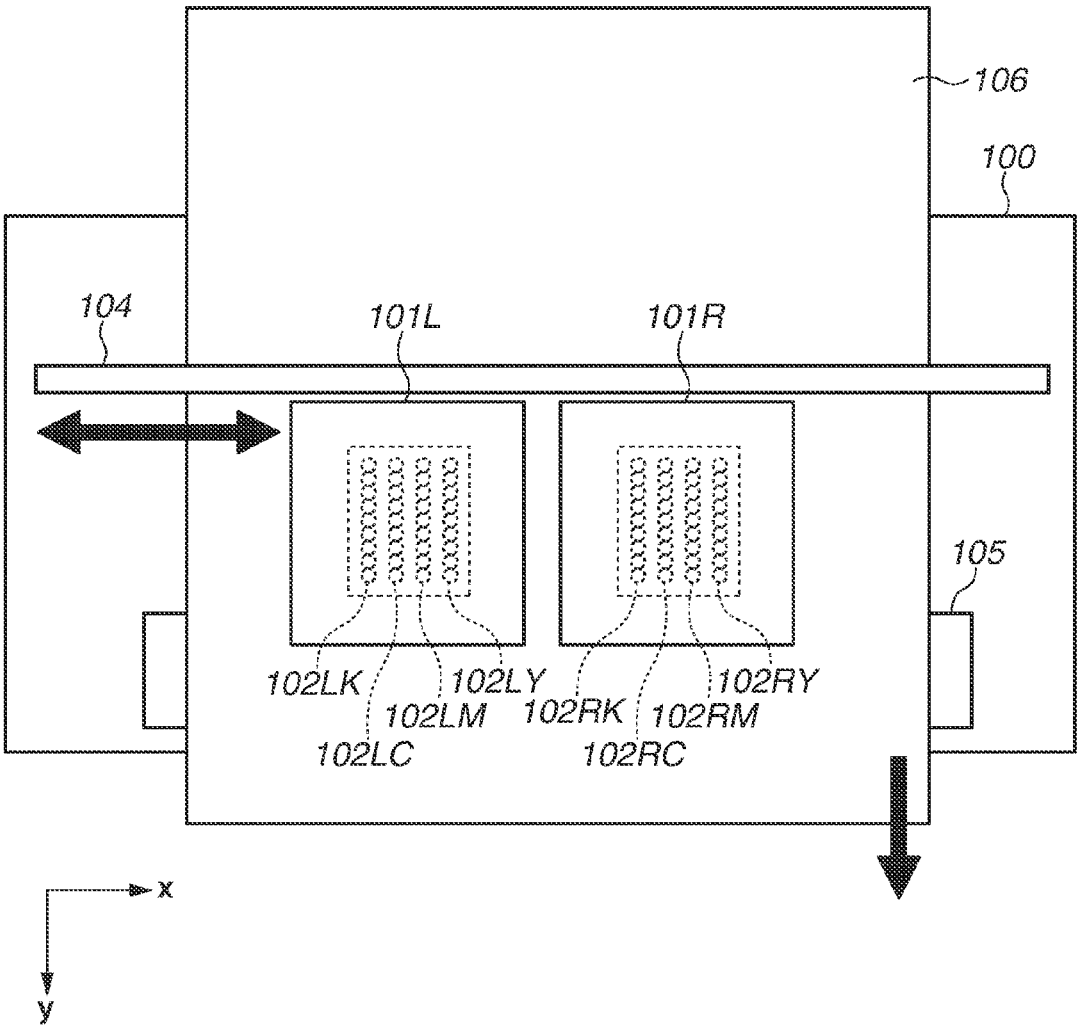
FIG. 1 is a schematic diagram illustrating an ink jet printer according to one or more aspects of the present disclosure.

FIG. 1 is a diagram schematically illustrating an ink jet printer according to an exemplary embodiment of the present disclosure. The ink jet printer of the present exemplary embodiment is a recording apparatus which records an image on a recording medium by using a plurality of color inks as recording materials. Herein, a black (K) ink as an achromatic ink and inks of respective colors of cyan (C), magenta (M), and yellow (Y) as chromatic inks are used. As illustrated in FIG. 1, a printer 100 includes two recording heads as recording units arranged on a frame serving as a structural member of the printer 100. A recording head on a left side in FIG. 1 is a recording head 101L, and a recording head on a right side in FIG. 1 is a recording head 101R. A recording chip is arranged on the recording head 101L, and a group of recording elements for discharging ink is arranged on the recording chip. Each of the recording elements of the present exemplary is a heating element which causes ink to bubble up by heating the ink with a heating body such as a heater to discharge ink, and the respective recording elements are provided within nozzles. Nozzle rows of respective ink colors, i.e., a black nozzle row 102LK, a cyan nozzle row 102LC, a magenta nozzle row 102LM, and a yellow nozzle row 102LY are arranged on the recording chip. Similarly, the recording chip on which a group of recording elements for discharging ink of a color the same as the color of ink dischargeable from the recording head 101L is provided is also arranged on the recording head 101R. The recording head 101R includes nozzle rows of a black nozzle row 102RK, a cyan nozzle row 102RC, a magenta nozzle row 102RM, and a yellow nozzle row 102RY.

The printer 100 is a so-called serial recording type printer. On the recording heads 101L and 101R, a plurality of nozzles is arranged in rows in a direction (Y-direction in FIG. 1) intersecting with a width direction (X-direction in FIG. 1) of a recording sheet 106 that is a recording medium by 90-degree. An image is recorded on the recording sheet 106 by making the recording heads 101L and 101R reciprocally scan in the X-direction (scanning direction) along a guide 104. The resolution of the nozzles arranged in each row is 1200 dot-per-inch (dpi). In other words, the nozzles are arranged in the Y-direction at an interval of 1/1200 inch.

The recording sheet 106 is conveyed in the Y-direction (conveyance direction) in FIG. 1. The recording sheet 106 is conveyed by a conveyance roller 105 (and the other rollers not illustrated in FIG. 1) rotated by a driving force of a motor (not illustrated). When the recording sheet 106 is fed thereto, ink is discharged from the nozzles of the recording heads 101L and 101R according to recording data, so that an image of a one-scanning width corresponding to a length of the nozzle rows in the Y-direction in FIG. 1 is recorded. Then, when recording corresponding to one time of scanning operation is ended, the recording sheet 106 is conveyed by a width corresponding to the length of the nozzle rows again, so that an image of a one-scanning width is recorded again through scanning operation of the recording heads 101L and 101R. By repeatedly conveying the recording sheet and discharging ink from the recording heads as described above, an image is recorded on the recording medium.

Figure 2:
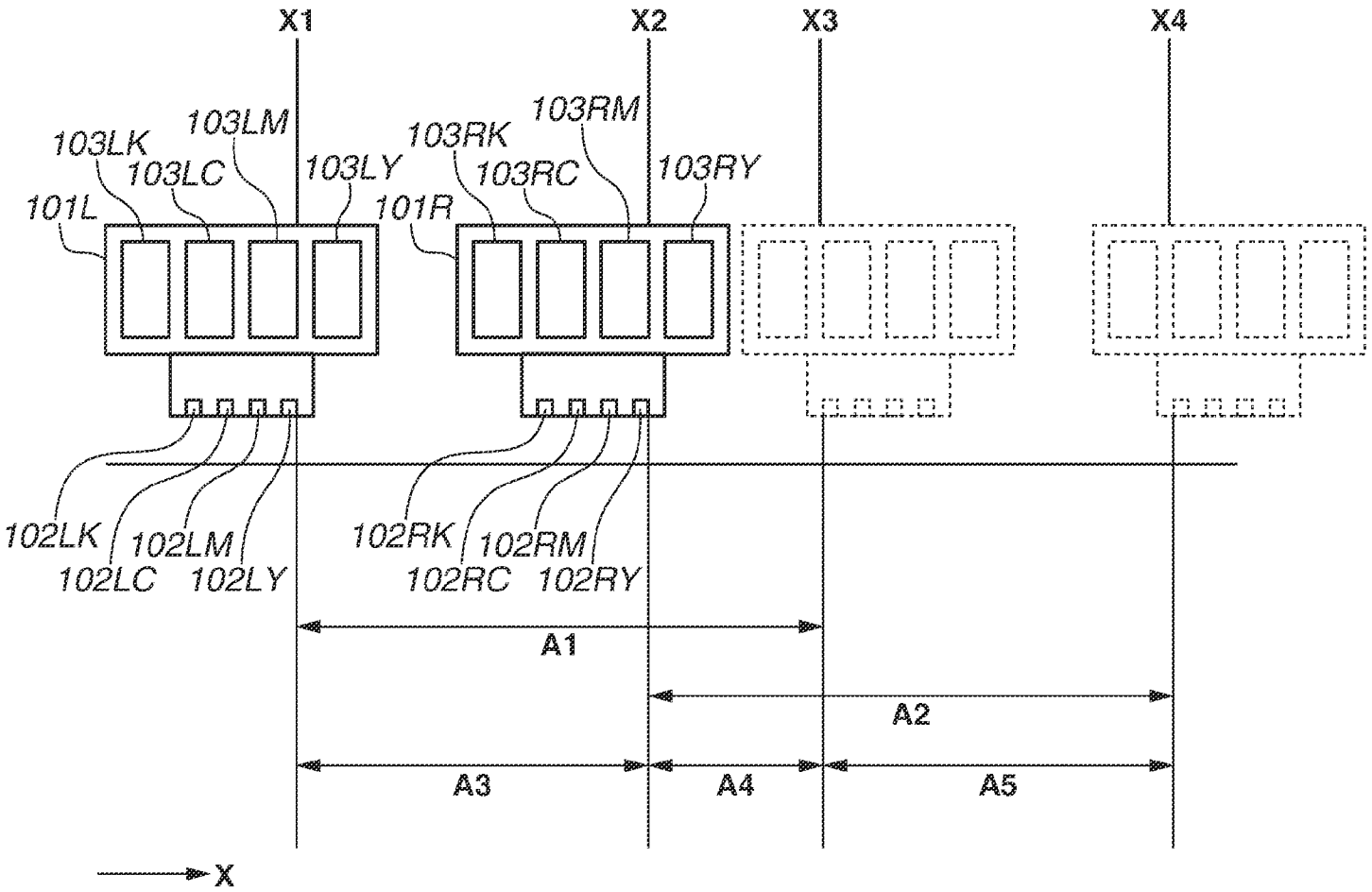
FIG. 2 is a schematic diagram illustrating a printer using two recording heads according to one or more aspects of the present disclosure.

FIG. 2 is a diagram illustrating a state where the printer 100 illustrated in FIG. 1 forms an image on the recording sheet 106 by using the recording heads 101L and 101R. In FIG. 2, the recording head 101L, the nozzle rows 102LK, 102LC, 102LM, and 102LY, the recording head 101R, and the nozzle rows 102RK, 102RC, 102RM, and 102RY are the same as those described in FIG. 1, and thus description thereof will be omitted. Ink tanks 103LK, 103LC, 103LM, and 103LY mounted on the recording head 101L store a black ink, a cyan ink, a magenta ink, and a yellow ink respectively. The ink tanks 103LK, 103LC, 103LM, and 103LY which store ink are connected to the nozzle rows 102LK, 102LC, 102LM, and 102LY of corresponding colors to supply ink thereto. Similarly, ink tanks 103RK, 103RC, 103RM, and 103RY mounted on the recording head 101R store a black ink, a cyan ink, a magenta ink, and a yellow ink respectively. The ink tank of the present exemplary embodiment is integrally configured of ink tanks of four colors such as black, cyan, magenta, and yellow. Then, this integrated ink tank is mounted on each of the right and left recording heads 101R and 101L. Accordingly, when any one of four color inks is consumed, the integrated ink tank has to be collectively replaced even if the other color inks remain in the integrated ink tank. Further, in the recording head of the present exemplary embodiment, the recording chip having a group of recording elements is configured integrally with the ink tank, so that the recording chip is also replaced when the ink tank is to be replaced.

Positions X1, X2, X3, and X4 expressed by straight lines in FIG. 2 are positions of the recording heads 101L and 101R in a scanning direction (X-direction) on a plane of the recording sheet 106. The ink jet printer of the present exemplary embodiment makes the recording heads 101L and 101R share an area on the recording medium to execute recording. The position X1 is a left edge of the area recordable by the recording head 101L, the position X2 is a left edge of the area recordable by the recording head 101R, the position X3 is a right edge of the area recordable by the recording head 101L, and the position X4 is a right edge of the area recordable by the recording head 101R. In FIG. 2, areas A1 and A2 represent areas in the X-direction on a plane of the recording sheet 106. The area A1 (first area) is an area where recording is executable by using the recording head 101L, and the area A2 (second area) is an area where recording is executable by using the recording head 101R. Then, the area A3 is an area where recording is executable by only the recording head 101L, and the area A5 is an area where recording is executable by only the recording head 101R. The area A4 is adjacent to the areas A3 and A5, and recording can be executed by using both of the recording heads 101L and 101R. Accordingly, the area A1 includes the areas A3 and A4, whereas the area A2 includes the areas A4 and A5.

Herein, the following three methods can be given as examples of the recording method of the area A4.

1. Execute recording by equally using the recording heads 101L and 101R.
2. Execute recording on an area on the left side of a predetermined position X in the area A4 by using the recording head 101L, and executes recording on an area on the right side of the position X by using the recording head 101R.
3. Execute recording by gradually changing a recording ratio, so that the recording head 101L is used more in the area A4 closer to the left edge position X2, and the recording head 101R is used more in the area A4 closer to the right edge position X3.

In the present disclosure, any of the above-described methods may be used.

Although details will be described below, the printer 100 of the present exemplary embodiment can execute recording on the area A4 between the positions X2 and X3 by using both of the recording heads 101L and 101R. However, when an image is to be actually recorded thereon, recording can be executed by using only one of the recording heads 101L and 101R. In this specification, of the area A4, an area where an image is actually recorded by using both of the recording heads 101L and 101R, i.e., an area where ink is discharged from both of the recording heads 101L and 101R, is called as "overlapping area", and the overlapping area is positioned between the position X2 and the position X3.

Figure 3:
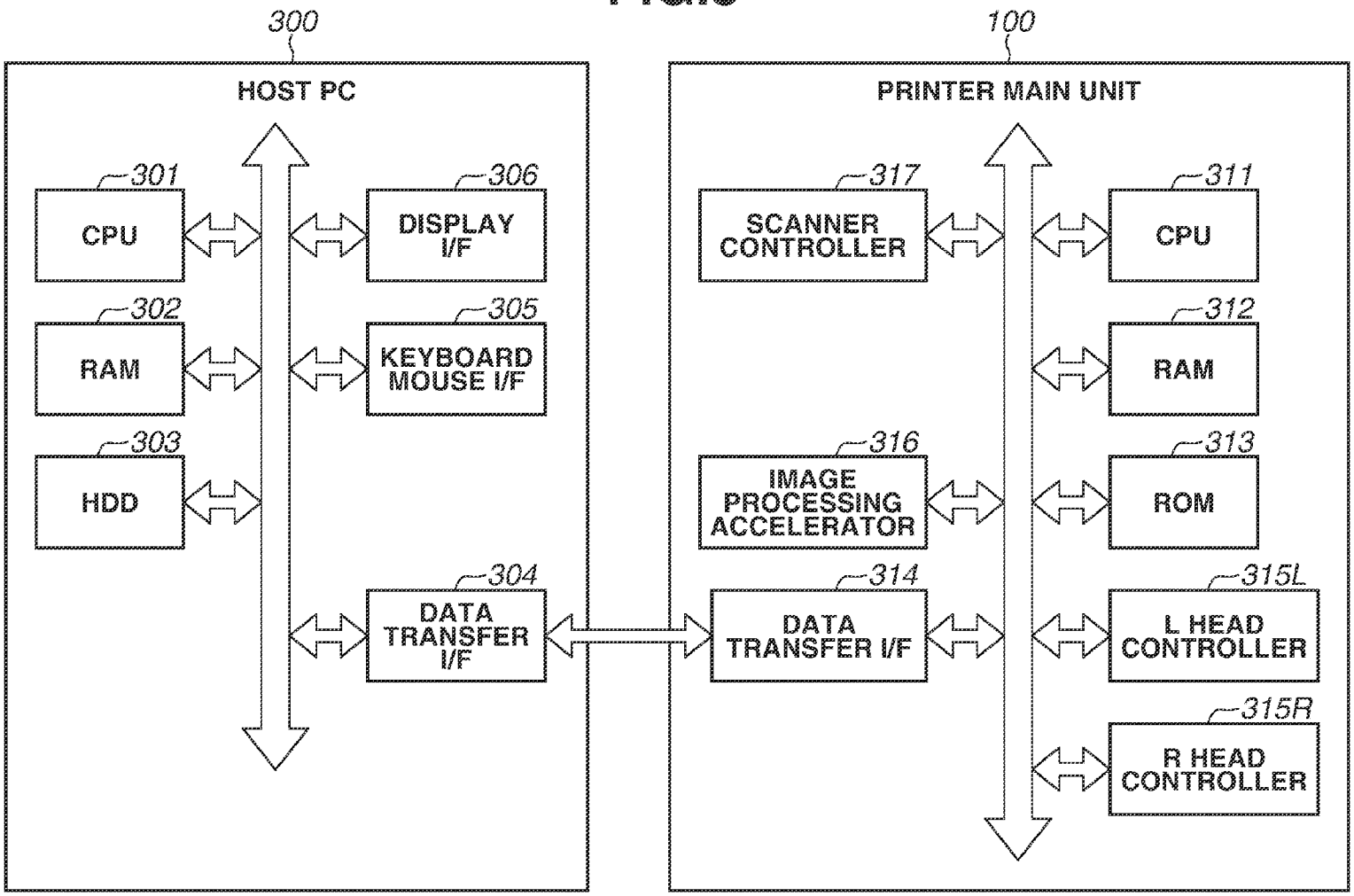
FIG. 3 is a diagram illustrating a configuration of a recording system according to one or more aspects of the present disclosure.

FIG. 3 is a block diagram illustrating a configuration example of the recording system according to the present exemplary embodiment. As illustrated in FIG. 3, the recording system is configured of the printer 100 serving as a recording apparatus illustrated in FIG. 1 and a personal computer (PC) 300 serving as a host apparatus of the recording apparatus.

The host PC 300 is mainly configured of the following elements. A central processing unit (CPU) 301 executes processing according to a program stored in a hard disk drive (HDD) 303 or a random access memory (RAM) 302. The RAM 302 is a volatile storage which temporarily stores programs and data. The HDD 303 is a non-volatile storage which also stores programs and data. A data transfer interface (I/F) 304 controls data transmission/reception executed between the PC 300 and the printer 100. The data transmission/reception can be executed through a connection method such as a universal serial bus (USB), a serial bus compliant with the Institute of Electrical and Electronics Engineers (IEEE) 1394 standard, or a local area network (LAN). A keyboard mouse I/F 305 is an interface for controlling a human interface device (HID) such as a keyboard or a mouse, and the user can input data through the keyboard mouse I/F 305. A display I/F 306 controls display of a display device (not illustrated).

On the other hand, the printer 100 is mainly configured of the following elements. A CPU 311 executes processing described below in FIG. 4 and subsequent drawings according to a program stored in a read only memory (ROM) 313 or a RAM 312. The RAM 312 is a volatile storage which temporarily stores programs and data. The ROM 313 is a non-volatile storage capable of storing table data created through the processing described below in FIG. 4 and subsequent drawings and programs.

A data transfer I/F 314 controls data transmission/reception executed between the printer 100 and the PC 300. The printer 100 receives a job for recording from the PC 300 via the data transfer I/F 314. A head controller 315L supplies recording data to the recording head 101L illustrated in FIG. 1 and controls discharge operation of the recording head 101L. Specifically, the head controller 315L reads a control parameter and recording data from a predetermined address in the RAM 312. When the CPU 311 writes the control parameter and the recording data into the predetermined address in the RAM 312, the processing is started by the head controller 315L, so that ink is discharged from the recording head 101L. Similarly, a head controller 315R supplies recording data to the recording head 101R illustrated in FIG. 1 and controls discharge operation of the recording head 101R. An image processing accelerator 316 is configured of hardware, and executes image processing at a speed higher than that of the CPU 311. Specifically, the image processing accelerator 316 reads a parameter and data necessary for image processing from a predetermined address in the RAM 312. When the CPU 311 writes the parameter and the data into the above-described predetermined address in the RAM 312, the image processing accelerator 316 is activated, so that predetermined image processing is executed. In addition, the image processing accelerator 316 is an element not always necessary, and the above-described creation processing of a table parameter or the image processing may be executed through only processing executed by the CPU 311, based on the specifications of the printer. Normally, the printer 100 is configured to execute image processing in an order from an upper portion of an image displayed on a display to execute recording on a recording medium. In addition, a scanner controller 317 controls a scanner sensing a device (not shown) for sensing a recorded image on the recording medium.

Figure 4A:
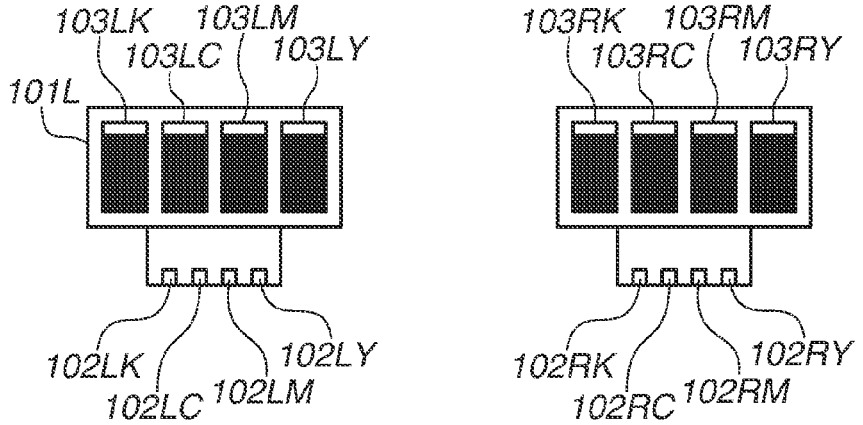
FIGS. 4A, 4B, and 4C are diagrams illustrating transition of a residual amount of ink within each ink tank according to one or more aspects of the present disclosure.
Figure 4B:
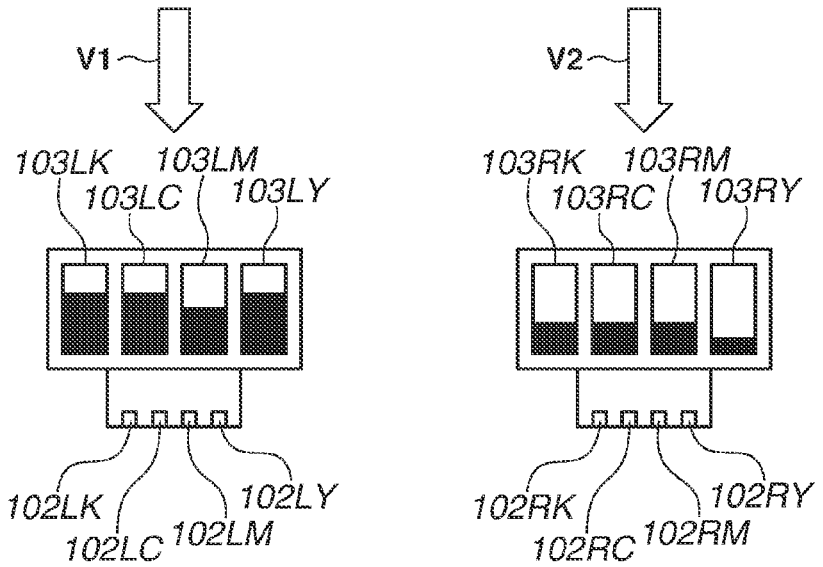
Figure 4C:
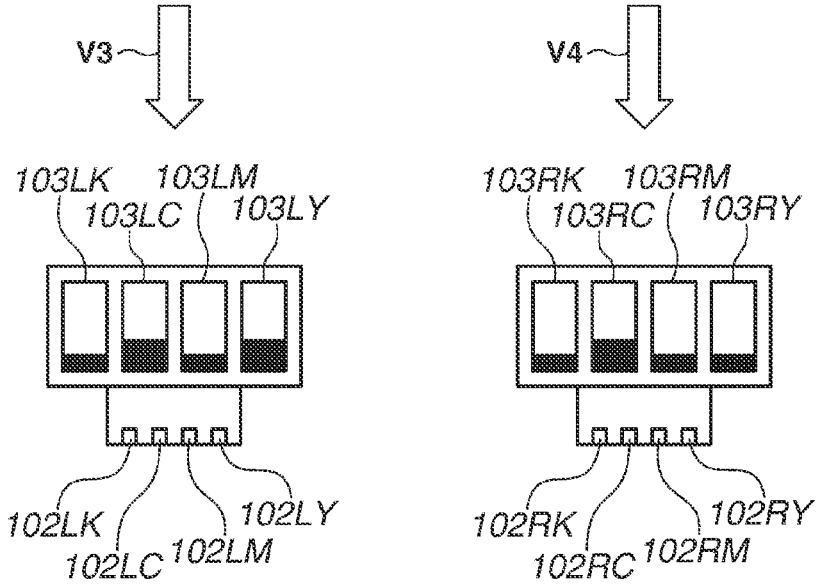

FIGS. 4A, 4B, and 4C are diagrams illustrating transition of a residual amount of ink in each ink tank. FIG. 4A is a diagram illustrating a state just after the recording heads 101L and 101R are attached to the printer 100 serving as a recording apparatus. The black ink tank 103LK, the cyan ink tank 103LC, the magenta ink tank 103LM, and the yellow ink tank 103LY are substantially filled with ink. Similarly, the black ink tank 103RK, the cyan ink tank 103RC, the magenta ink tank 103RM, and the yellow ink tank 103RY are substantially filled with ink.

Here, it is assumed that a certain amount of recording of a document (image data) that includes more content in a right side area of the recording medium (i.e., a recording area of the recording head 101R) is executed by using the recording heads 101L and 101R in a state illustrated in FIG. 4A. At this time, transitions V1 and V2 arise as illustrated in FIG. 4A, so that the residual amounts are brought into a state illustrated in FIG. 4B. In the example of FIG. 4B, residual amounts of a black ink (ink tank 103RK), a cyan ink (ink tank 103RC), a magenta ink (ink tank 103RM), and a yellow ink (ink tank 103RY) of the recording head 101R are less than residual amounts of respective inks of the recording head 101L. Hereinafter, in this specification, when a difference between the residual amounts of ink tanks corresponding to the right and the left recording heads 101R and 101L is considerably large, such a state is called as "unsymmetrical reduction". If recording is continuously executed in a state of "unsymmetrical reduction", there is a high possibility that a shortage arises in any of the inks of the recording head 101R. On the other hand, FIG. 4C is a diagram illustrating an example of a residual amount of ink as a target of the present disclosure. The residual amounts of the ink stored in the ink tanks 103RK, 103RC, 103RM, and 103RY of the recording head 101R are substantially the same as the residual amounts of the ink of corresponding colors of the ink tanks 103LK, 103LC, 103LM, and 103LY of the recording head 101L. Accordingly, if recording is executed continuously from the state illustrated in FIG. 4C, when any of the black ink and the color inks of the recording head 101R is consumed, there is a high possibility that the ink of corresponding color of the recording head 101L is almost consumed. Accordingly, it is necessary to reduce a difference between the residual amounts of the ink in the ink tanks corresponding to the right and the left recording heads 101R and 101L by generating transitions V3 and V4 in FIG. 4B to change the state in FIG. 4B to the state in FIG. 4C.

In the present exemplary embodiment, from the state illustrated in FIG. 4B, a use ratio of the recording head 101L is increased, so that a difference between the residual amounts of the ink of the recording heads 101L and 101R is reduced. With this configuration, the ink within the mounted ink tanks can be efficiently used, and an amount of recording executable by using the ink tanks can be increased.

In addition, when a certain amount of recording of a document (image data) that includes more content in a left side area of the recording medium (i.e., a recording area of the recording head 101L) is executed in a state in FIG. 4A, the residual amounts of the ink within the ink tanks illustrated in FIG. 4B is reversed. In other words, the residual amounts of the ink within the ink tanks of the recording head 101L are less than the residual amounts of the ink within the ink tanks of the recording head 101R. Accordingly, in this case, it is necessary to execute control of changing a state to the state illustrated in FIG. 4C by increasing a use ratio of the ink within the ink tanks corresponding to the recording head 101R.

Further, in a state where the residual amounts of the ink within the ink tanks of one of the right and the left recording heads 101R and 101L are considerably less than the residual amounts of the ink within another of the ink tanks 101R and 101L as illustrated in FIG. 4B, there is a possibility that image quality is lowered because of a factor other than the shortage of ink, i.e., "condensation of ink caused by evaporation of water included in ink". Evaporation of water within the ink is accelerated when a ratio of an air volume to an ink volume within the ink tank is greater. In other words, there arises a problem in that density of a recording image is increased because the evaporation amount at the recording head 101R is greater in a state illustrated in FIG. 4B. Because the present exemplary embodiment is intended to approximate the residual amounts of the ink in the right and the left ink tanks, it is also possible to acquire an effect of suppressing a difference in colors caused by a difference in evaporation amounts, which arises in the respective images recorded by the right and the left recording heads 101R and 101L.

In the present exemplary embodiment, attention is focused on the black ink of the recording heads 101L and 101R, and an amount of recording executable by using the black ink tank 103LK corresponding to the recording head 101L and the black ink tank 103RK corresponding to the recording head 101R is increased.

Figure 5:
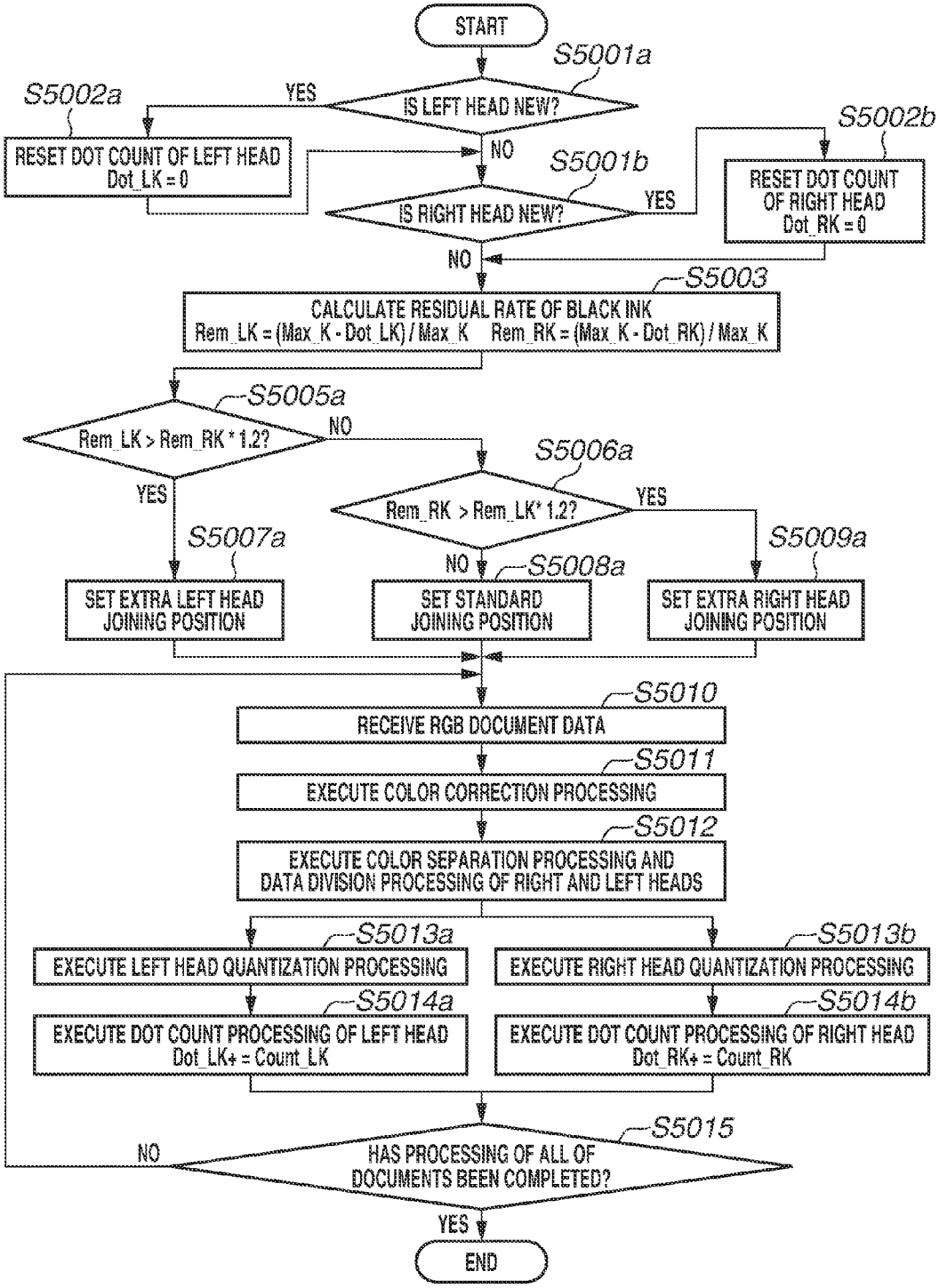
FIG. 5 is a flowchart illustrating processing of a first exemplary embodiment according to one or more aspects of the present disclosure.

The processing flow of the present exemplary embodiment is illustrated in FIG. 5. This flowchart illustrates division processing of shared recording executed by the recording heads 101L and 101R mounted on the printer 100 illustrated in FIG. 1. The processing is executed by the CPU 311 illustrated in FIG. 3, and the processing flow is executed by a job unit. Normally one job includes one or more pages of documents.

When a printing flow is started, in step S5001*a*, the CPU 311 judges whether the recording head 101L mounted on the recording apparatus is new. If the CPU 311 judges that the recording head 101L is new (YES in step S5001*a*), the processing proceeds to step S5002*a*. In step S5002*a*, the CPU 311 resets a number of times of discharge (i.e., dot count) counted at the recording head 101L, and the processing proceeds to step S5001*b*. In step S5001*a*, if the CPU 311 judges that the recording head 101L is not new but has been used before (NO in step S5001*a*), the processing simply proceeds to step S5001*b* because the dot count of inks discharged up to this time is carried over.

In step S5001*b*, the CPU 311 judges whether the recording head 101R mounted on the recording apparatus is new. If the CPU 311 judges that the recording head 101R is new (YES in step S5001*b*), the processing proceeds to step S5002*b*. In step S5002*b*, the CPU 311 resets a number of times of discharge (i.e., dot count) counted at the recording head 101R, and the processing proceeds to step S5003. In step S5001*b*, if the CPU 311 judges that the recording head 101R is not new but has been used before (NO in step S5001*b*), the processing simply proceeds to step S5003 because the dot count of inks discharged up to this time is carried over.

In step S5003, a residual rate of the black ink of each of the right and the left recording heads 101R and 101L is calculated through the following formulas.

$$\text{Rem_}LK=(\text{Max_}K-\text{Dot_}LK)/\text{Max_}K$$

$$\text{Rem_}RK=(\text{Max_}K-\text{Dot_}RK)/\text{Max_}K$$

Here, a value Rem_LK is a residual rate of the black ink of the recording head 101L, and a full state is represented by 1.0 whereas an empty state is represented by 0.0. Similarly, a value Rem_RK is a residual rate of the black ink of the recording head 101R, and a full state is represented by 1.0 whereas an empty state is represented by 0.0.

A constant number Max_K represents a maximum number of pixels recordable when a black ink tank is full (i.e., a maximum dischargeable dot count), and a value thereof is determined according to a size of the ink tank and a discharge amount of the recording head. In the present exemplary embodiment, the constant number Max_K is common to the recording heads 101L and 101R.

A value Dot_LK represents a dot count of the black ink discharged by the time of judgement after a new recording head 101L formed integrally with the ink tanks is attached. Similarly, a value Dot_RK represents a dot count of the black ink discharged by the time of judgement after a new recording head 101R is attached.

Next, in steps S5005*a* to S5009*a*, the CPU 311 sets "joining position information" indicating a position of an overlapping area where both of the recording heads 101R and 101L are used for actually executing recording, on the area A4 where recording can be executed by both of the right and the left recording heads 101R and 101L. In step S5005*a*, the CPU 311 judges whether the residual amount of the black ink of the recording head 101L is greater than an amount predetermined times as much as the residual amount of the black ink of the recording head 101R. In the present exemplary embodiment, the CPU 311 judges whether the residual amount of the black ink of the recording head 101L is greater than an amount 1.2 times as much as the residual amount of the black ink of the recording head 101R, through the following formula.

$$\text{Rem_}LK>\text{Rem_}RK*1.2$$

Here, if the determination result is "YES" (YES in step S5005*a*), e.g., if a residual amount of the black ink of the recording head 101L is an amount 1.5 times as much as the residual amount of the black ink of the recording head 101R, this indicates a state where the amount of the black ink of the recording head 101R is considerably reduced. At this time, the processing proceeds to step S5007*a*, so that the CPU 311 sets the joining position information indicating a position of the overlapping area as "joining position where the recording head 101L is used more". Then, the processing proceeds to step S5010.

On the other hand, if the determination result in step S5005*a* is "NO" (NO in step S5005*a*), the processing proceeds to step S5006*a*.

In step S5006*a*, the CPU 311 judges whether the residual amount of the black ink of the recording head 101R is greater than an amount predetermined times as much as the residual amount of the black ink of the recording head 101L. In the present exemplary embodiment, the CPU 311 judges whether the residual amount of the black ink of the recording head 101R is greater than an amount 1.2 times as much as the residual amount of the black ink of the recording head 101L, through the following formula.

$$\text{Rem_}RK>\text{Rem_}LK*1.2$$

Here, if the determination result is "YES" (YES in step S5006*a*), e.g., if a residual amount of the black ink of the recording head 101R is an amount 1.5 times as much as the residual amount of the black ink of the recording head 101L, this indicates a state where the amount of the black ink of the recording head 101L is considerably reduced. At this time, the processing proceeds to step S5009*a*, so that the CPU 311 sets the joining position information indicating a position of the overlapping area as "joining position where the recording head 101R is used more". Then, the processing proceeds to step S5010.

When the determination result in step S5006*a* is "NO" (NO in step S5006*a*), the residual amounts of the ink of one of the recording heads 101L and 101R is equal to or less than an amount 1.2 times as much as the residual amount of another of the recording heads 101L and 101R. This indicates a state where the residual amounts of the black ink of the right and the left ink tanks are substantially the same, and thus a difference between the residual amounts is small. At this time, the processing proceeds to step S5008*a*, so that the CPU 311 sets the joining position information indicating a position of the overlapping area as "standard joining position". Then, the processing proceeds to step S5010.

Through the above-described processing of determining the joining position information, a range of the overlapping area is set in such a manner that the black ink of the ink tank having a greater residual amount is used more when a difference between the residual amounts of the right and the left black ink tanks is greater than a predetermined amount. Specifically, the joining position is determined in such a manner that a length in the scanning direction of an area where recording is executed by only a recording head corresponding to the ink tank having a greater residual amount is set to be greater than a length in the scanning direction of an area where recording is executed by only a recording head corresponding to the ink tank having a less residual amount.

In addition, the constant number 1.2 and the judgement formulas used for the judgement in steps S5005*a* and S5006*a* are merely examples, and another constant number or another judgement method may be used. In the example illustrated in FIG. 5, judgement is made based on a ratio of the residual amounts of the ink of the right and the left black ink tanks. However, for example, judgement may be made based on whether a difference between the residual amounts is equal to or less than a predetermined amount.

For example, in step S5005*a*, the following formula may be used in place of the above-described formula.

$$\text{Rem_}LK-\text{Rem_}RK>Th$$

Here, "Th" represents a threshold value of a difference between the residual amounts, and can be set as "Th=Max_K/2".

After the joining position is determined through the processing in steps S5005*a* to S5009*a*, the processing proceeds to step S5010. In steps S5010 to S5015, image processing is actually executed on image data of documents. In step S5010, the CPU 311 receives a red-green-blue (RGB) image of a document. In step S5011, the CPU 311 executes color correction processing of converting the RGB colors of the document into RGB values preferable for recording. This color correction processing may be executed through known preferable processing. In step S5012, the CPU 311 executes color separation processing and data division processing of the right and the left recording heads 101L and 101R, which convert the RGB values into allocation amounts of respective inks of black, cyan, magenta, and yellow of the recording heads 101L and 101R. A known preferable processing may be used for a method of the color separation processing. In the present exemplary embodiment, for the sake of simplicity, input values of the color separation processing are expressed as Rin, Gin, and Bin. Then, the processing is executed according to the following formulas while the output values of the recording heads 101L are expressed as LKout, LCout, LMout, and LYout, and the output values of the recording head 101R are expressed as RKout, RCout, RMout, and RYout. Here, the input values Rin, Gin, and Bin, and the output values LKout, LCout, LMout, LYout, RKout, RCout, RMout, and RYout are 8-bit values each having a value range of 0 to 255.

$$C=255-R\text{in}$$

$$M=255-G\text{in}$$

$$Y=255-B\text{in}$$

$$K=\min(C, M, Y)$$

$$C'=C-K$$

$$M'=M-K$$

$$Y'=Y-K$$

Hereinafter, the processing will be described in detail because different processing is executed with respect to each of the areas A3, A4, and A5 in FIG. 2. Formulas for calculating the allocation amounts of the ink with respect to the area A3 are expressed as follows.

$$LK\text{out}=LK_\text{Table}[K]$$

$$LC\text{out}=C'+LC_\text{Table}[K]$$

$$LM\text{out}=M'+LM_\text{Table}[K]$$

$$LY\text{out}=Y'+LY_\text{Table}[K]$$

$$(RK\text{out}, RC\text{out}, RM\text{out}, RY\text{out}=0)$$

Figure 7:
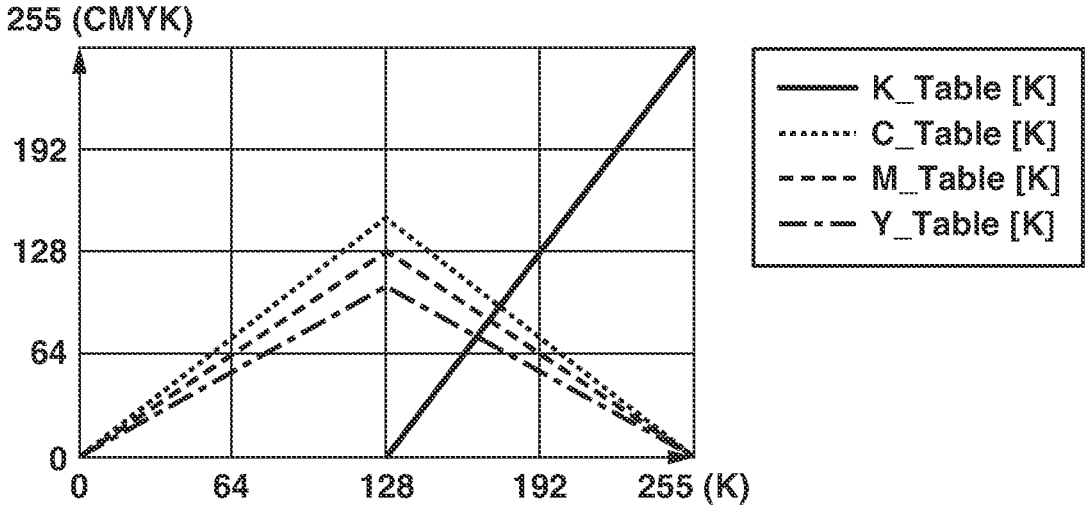
FIG. 7 is a diagram illustrating a color separation table according to one or more aspects of the present disclosure.

Here, color separation tables LK_Table, LC_Table, LM_Table, and LY_Table of the recording head 101L are used for setting the allocation amounts of respective inks of K, C, M, and Y for realizing a required density K of a gray image. In the present exemplary embodiment, a color separation table illustrated in FIG. 7 is used.

Formulas for calculating the allocation amounts with respect to the area A5 are expressed as follows.

$$RK\text{out}=RK_\text{Table}[K]$$

$$RC\text{out}=C'+RC_\text{Table}[K]$$

$$RM\text{out}=M'+RM_\text{Table}[K]$$

$$RY\text{out}=Y'+RY_\text{Table}[K]$$

$$(LK\text{out}, LC\text{out}, LM\text{out}, LY\text{out}=0)$$

Here, color separation tables RK_Table, RC_Table, RM_Table, and RY_Table of the recording head 101R are used for setting the allocation amounts of respective inks of K, C, M, and Y for realizing a required density K of a gray image. In the present exemplary embodiment, the color separation table illustrated in FIG. 7 is used.

Formulas for calculating the allocation amounts with respect to the area A4 are expressed as follows.

$$LK\text{out}=LK_\text{Table}[K]\times a1+RK_\text{Table}[K]\times b1$$

$$LC\text{out}=(C'+LC_\text{Table}[K])\times a2+(C'+RC_\text{Table}[K])\times b2$$

$$LM\text{out}=(M'+LM_\text{Table}[K])\times a3+(M'+RM_\text{Table}[K])\times b3$$

$$LY\text{out}=(Y'+LY_\text{Table}[K])\times a4+(Y'+RY_\text{Table}[K])\times b4$$

$$RK\text{out}=LK_\text{Table}[K]\times c1+RK_\text{Table}[K]\times d1$$

$$RC\text{out}=(C'+LC_\text{Table}[K])\times c2+(C'+RC_\text{Table}[K])\times d2$$

$$RM\text{out}=(M'+LM_\text{Table}[K])\times c3+(M'+RM_\text{Table}[K])\times d3$$

$$RY\text{out}=(Y'+LY_\text{Table}[K])\times c4+(Y'+RY_\text{Table}[K])\times d4$$

Here, respective coefficients a1 to a4, b1 to b4, c1 to c4, and d1 to d4 are determined as appropriate according to how recording is executed on the area A4 by the recording heads 101L and 101R.

Although three methods are described as examples of the recording method of the area A4, favorable recording can be executed by making the following settings with respect to the three methods.

In the above-described method 1, a ratio of using each of the recording heads 101L and 101R in the overlapping area is set as 50% each. By setting the coefficients a1 to a4 as 0.25, the coefficients b1 to b4 as 0.25, the coefficients c1 to c4 as 0.25, and the coefficients d1 to d4 as 0.25, amounts of ink used for recording can be equalized at the right and the left recording heads 101R and 101L.

In the above-described method 2, a width of the overlapping area is set as 0 so that recording is executed on an area on the left side of a predetermined position X in the area A4 by using the recording head 101L, while recording is executed on an area on the right side of the predetermined position X by using the recording head 101R. With respect to the pixels on the left side of the predetermined position X, the coefficients a1 to a4 are set as 1.00, the coefficients b1 to b4 are set as 0.00, the coefficients c1 to c4 are set as 0.00, and the coefficients d1 to d4 are set as 0.00. With respect to the pixels on the right side of the predetermined position X, the coefficients a1 to a4 are set as 0.00, the coefficients b1 to b4 are set as 0.00, the coefficients c1 to c4 are set as 0.00, and the coefficients d1 to d4 are set as 1.00.

In the above-described method 3, recording is executed by gradually changing the recording ratio, so that the recording head 101L is used more in the overlapping area closer to the left edge spanning from the center to the left side thereof, while the recording head 101R is used more in the overlapping area closer to the right edge spanning from the center to the right side thereof.

$$a1 \text{ to } a4=(w-x)/w*(w-x)/w$$

$$b1 \text{ to } b4=x/w*(w-x)/w$$

$$c1 \text{ to } c4=x/w*x/w$$

$$d1 \text{ to } d4=(w-x)/w*x/w$$

Here, "w" represents a width (number of pixels) of the area A4, and "x" represents a pixel position (number of pixels) of a processing target pixel from the left edge of the area A4. Accordingly, "x" is equal to 0 (x=0) at the left edge of the area A4, and "x" is equal to "w" (x=w) at the right edge of the area A4.

The output data LKout, LCout, LMout, and LYout of the area A1 (A3+A4) in FIG. 2 are output from the recording head 101L as a processing result of step S5012. Further, the output data RKout, RCout, RMout, and RYout of the area A2 (A4+A5) in FIG. 2 are output from the recording head 101R.

In the above-described exemplary embodiment, the coefficients a1 to a4, b1 to b4, c1 to c4, and d1 to d4 for favorably executing recording on the recording area A4 are described based on the condition that dots are ideally arranged on the recording sheet 106 with very few blurring of ink. When recording is actually executed by the printer 100, favorable coefficients can be set as appropriate with respect to variation in the recording condition of dots or blurring of ink. Further, in the present exemplary embodiment, although the exemplary embodiment in which output values are calculated and output as appropriate by using the coefficients a1 to a4, b1 to b4, c1 to c4, and d1 to d4 has been described, processing may be executed by using an input/output conversion table on which the coefficients are reflected, which is previously calculated at each recording pixel position.

FIG. 7 is a diagram illustrating an example of a conversion table used for the color separation processing of the present exemplary embodiment. Through the color separation processing, data indicating an allocation amount of each ink is generated based on the image data input thereto. Data used for conversion is a conversion table for separating the colors into a gray image having a required density ranging from 0 to 255. Density of a gray color becomes lower when a value thereof is smaller, and becomes higher when a value thereof is larger, and the highest density is represented by a value 255. In FIG. 7, because common color separation tables are applicable to the recording heads 101L and 101R, the conversion tables are described as K_Table, C_Table, M_Table, and Y_Table. Further, the color separation tables described below are conversion tables for outputting CMYK values with respect to the CMYK values input thereto. A horizontal axis described below represents values 0 to 255 of black (K) in 256 gradations, and this represents a gray image having the values of C, M, and Y equal to 0 (C=M=Y=0). A vertical axis represents output values of C, M, Y, and K, which relate to the allocation amounts of respective inks. In addition, input values of the color separation table are not limited to the CMYK values, but may be the RGB values. When the input values are RGB values, a gray image is realized when values of R, G, and B are equal to each other (R=G=B), and the horizontal axis may take a value of any one of the values of R, G, and B.

The horizontal axis represents a required density K of the gray image, whereas the vertical axis represents allocation amounts of respective inks of black, cyan, magenta, and yellow used for realizing the required density K of the gray image. In FIG. 7, at required densities 0 to 128 of gray colors in low gradation, gray colors are realized by only color inks of cyan, magenta, and yellow, and the amounts thereof are monotonically increased. At this time, the allocation amount of the black ink is 0. The gray colors are realized by a black ink and color inks at required densities of 129 to 254, and a gray color is realized by only a black ink at the required density of 255. Then, the allocation amount of the black ink becomes greater than 0 from intermediate densities. The gray image is realized by using both of the black ink and the color inks at the required densities of 129 to 254. In the high gradation, the allocation amount of the black ink is monotonically increased while the allocation amounts of the color inks are monotonically decreased. The gray image is realized by only the black ink without using the color inks at the highest required density 255.

FIGS. 8A to 8C, 9A to 9C, and 10A to 10C are diagrams illustrating the use ratio of the recording heads 101L and 101R for executing recording on the overlapping area where joining processing is executed. The use ratio will be described with respect to three examples of joining position information, i.e., "extra left-head joining position", "standard joining position", and "extra right-head joining position" set in steps S5005*a* to S5009*a*.

Figure 8A:
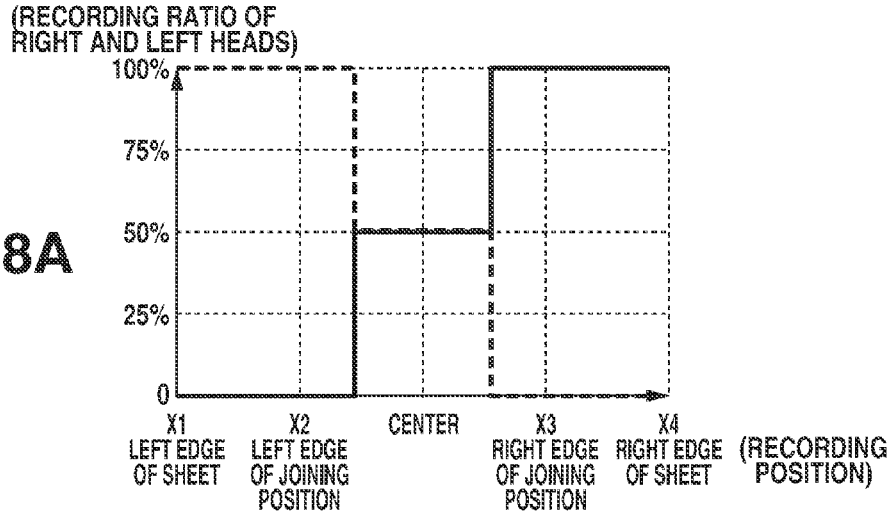
FIGS. 8A, 8B, and 8C are diagrams illustrating examples of joining processing according to one or more aspects of the present disclosure.
Figure 8B:
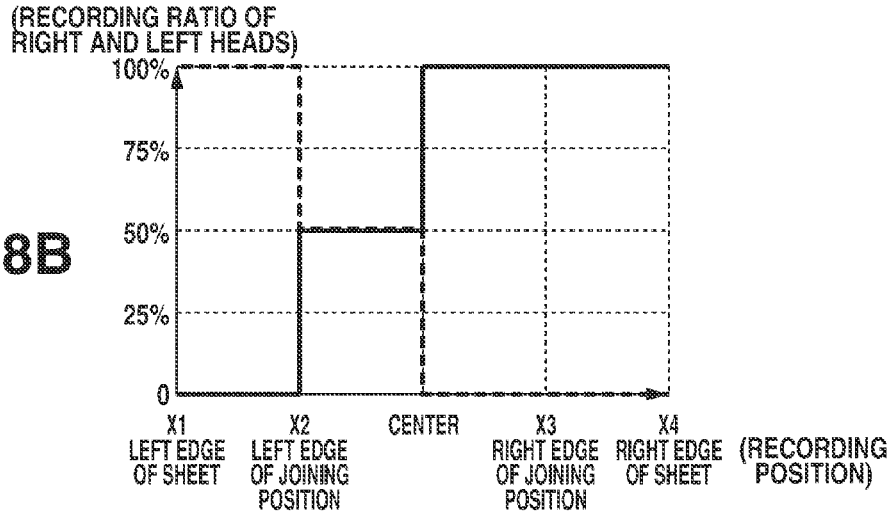
Figure 8C:
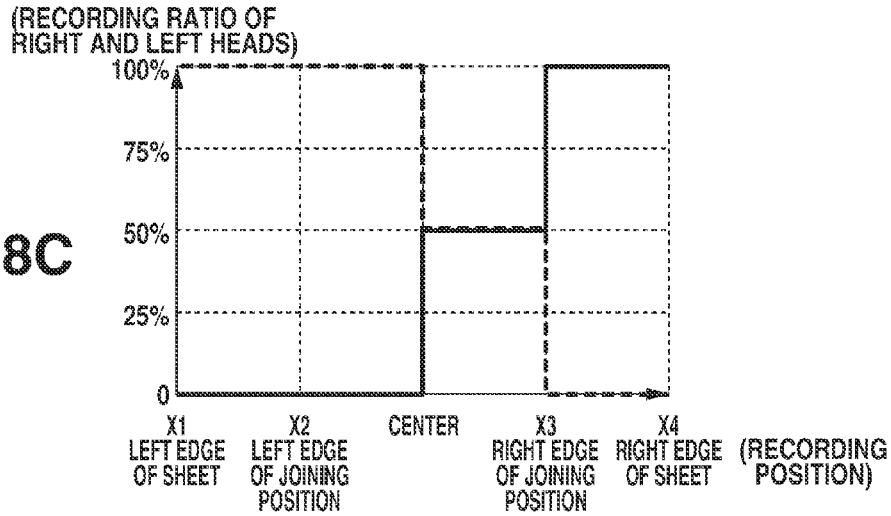

In FIGS. 8A to 8C, a part of the area A4 is set as an overlapping area where recording is executed by using both of the recording heads 101L and 101R, and the recording heads 101L and 101R are equally used in the overlapping area. In other words, processing is executed so as to allocate 50% each of recording data pieces to the right and the left recording heads 101R and 101L. FIG. 8A illustrates an example of "standard joining position", FIG. 8B illustrates an example of "extra right-head joining position", and FIG. 8C illustrates an example of "extra left-head joining position". In each of FIGS. 8A to 8C, a horizontal axis represents a position in the x-direction on a plane of a recording sheet.

A position X1 corresponds to the left edge of the recording area of the recording head 101L, a position X2 corresponds to the left edge of the area A4, a position X3 corresponds to the right edge of the area A4, and a position X4 corresponds to the right edge of the recording area of the recording head 101R illustrated in FIG. 2. In each of the examples illustrated in FIGS. 8A to 8C, the overlapping area where joining processing is executed is an area having a half the width of the area A4 in the scanning direction of the recording head.

When "standard joining position" in FIG. 8A is set thereto, the overlapping area where joining processing is executed by both of the right and the left recording heads 101R and 101L is an area positioned at the center of the area A4, which is spanning from a position "X2+A4 width/4" to a position "X3−A4 width/4". Accordingly, a length in the X-direction of the area A1 and a length in the X-direction of the area A2 are the same. Setting examples of the coefficients a1 to a4, b1 to b4, c1 to c4, and d1 to d4 used for the calculation in step S5011 are described as follows.

When a target position is a position on the left side of the position "X2+A4 width/4", the coefficients are set as follows.

a1 to a4=1.00 b1 to b4=0.00 c1 to c4=0.00 d1 to d4=0.00

When a target position is a position on the right side of the position "X2+A4 width/4" and on the left side of the position "X3−A4 width/4", the coefficients are set as follows.

a1 to a4=0.25 b1 to b4=0.25 c1 to c4=0.25 d1 to d4=0.25

When a target position is a position on the right side of the position "X3−A4 width/4", the coefficients are set as follows.

a1 to a4=0.00 b1 to b4=0.00 c1 to c4=0.00 d1 to d4=1.00

Similarly, when "extra right-head joining position" in FIG. 8B is set thereto, the overlapping area where joining processing is executed by using both of the right and the left recording heads 101R and 101L is a left-half area spanning from the position X2 to the center of the area A4. Accordingly, a length in the X-direction of the area A2 is greater than a length in the X-direction of the area A1. Setting examples of the coefficients a1 to a4, b1 to b4, c1 to c4, and d1 to d4 used for the calculation in step S5011 are described as follows.

When a target position is a position on the left side of the position "X2+A4 width/2", the coefficients are set as follows.

a1 to a4=0.25 b1 to b4=0.25 c1 to c4=0.25 d1 to d4=0.25

When a target position is a position on the right side of the position "X2+A4 width/2", the coefficients are set as follows.

a1 to a4=0.00 b1 to b4=0.00 c1 to c4=0.00 d1 to d4=1.00

Similarly, when "extra left-head joining position" in FIG. 8C is set thereto, an overlapping area where joining processing is executed by both of the right and the left recording heads 101R and 101L is a right-half area spanning from the center of the area A4 to the position X3. Accordingly, a length in the X-direction of the area A1 is greater than a length in the X-direction of the area A2. Setting examples of the coefficients a1 to a4, b1 to b4, c1 to c4, and d1 to d4 used for the calculation in step S5011 are described as follows.

When a target position is a position on the left side of the position "X2+A4 width/2", the coefficients are set as follows.

a1 to a4=1.00 b1 to b4=0.00 c1 to c4=0.00 d1 to d4=0.00

When a target position is a position on the right side of the position "X2+A4 width/2", the coefficients are set as follows.

a1 to a4=0.25 b1 to b4=0.25 c1 to c4=0.25 d1 to d4=0.25

Figure 9A:
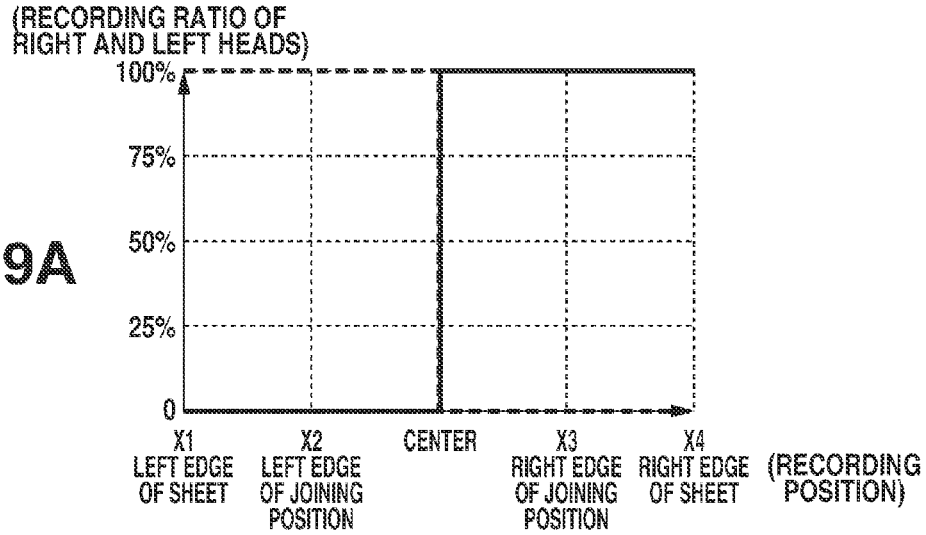
FIGS. 9A, 9B, and 9C are diagrams illustrating examples of joining processing according to one or more aspects of the present disclosure.
Figure 9B:
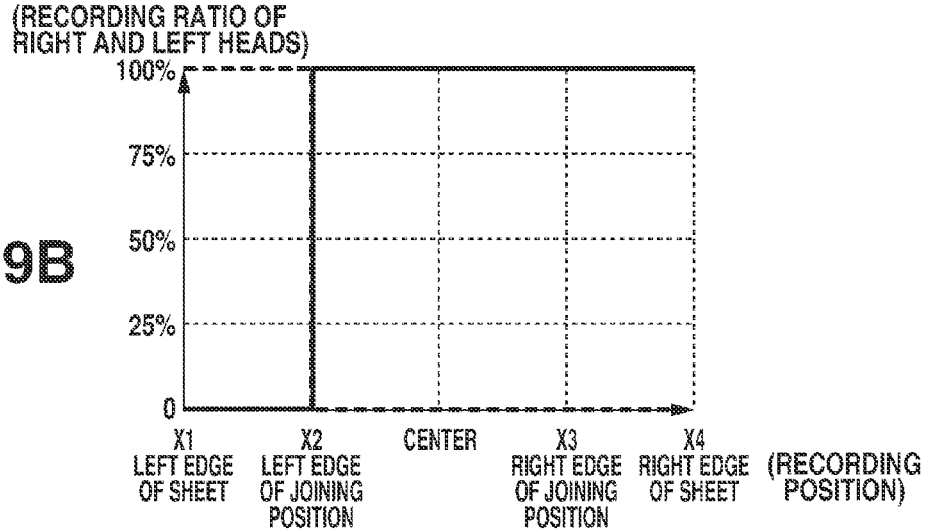
Figure 9C:
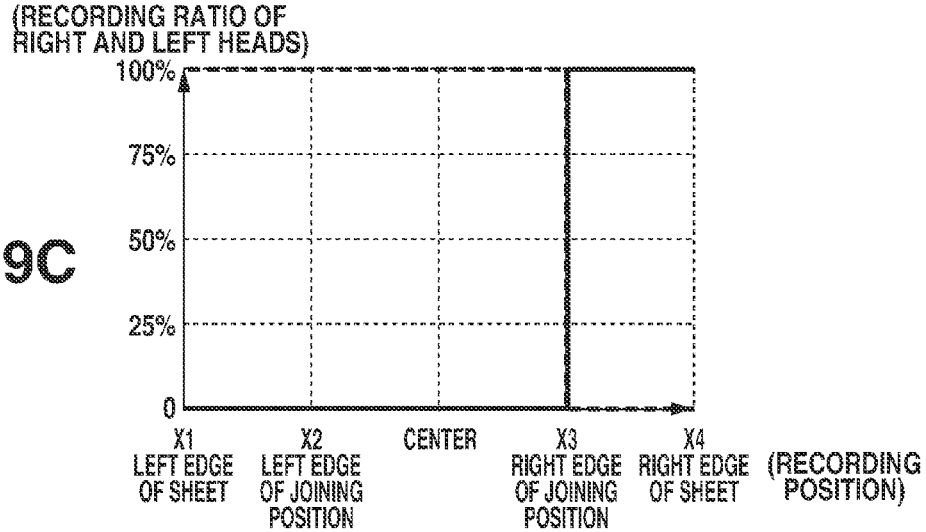

In FIGS. 9A to 9C, a width of the overlapping area is set as 0, so that recording is executed on an area on the left side of a predetermined position X in the area A4 by the recording head 101L, and recording is executed on an area on the right side thereof by the recording head 101R. Recording is executed on the area on the left side of the predetermined position X in the area A4 by using the recording head 101L, whereas recording is executed on the area on the right side of the predetermined position X in the area A4 by using the recording head 101R. In other words, there is no overlapping area where recording is executed by using both of the right and the left recording heads 101R and 101L, and thus recording is executed thereon by any one of the recording heads 101R and 101L. FIG. 9A illustrates an example of "standard joining position", FIG. 9B illustrates an example of "extra right-head joining position", and FIG. 9C illustrates an example of "extra left-head joining position". The horizontal axis is similar to the horizontal axis described in FIGS. 8A to 8C, so that description thereof will be omitted.

When "standard joining position" in FIG. 9A is set thereto, a recording head to be used is switched by making a central position of the area A4 as a joining position. Setting examples of the coefficients a1 to a4, b1 to b4, c1 to c4, and d1 to d4 used for the calculation in step S5011 are described as follows.

When a target position is a position on the left side of the position "X2+A4 width/2", the coefficients are set as follows.

a1 to a4=1.00 b1 to b4=0.00 c1 to c4=0.00 d1 to d4=0.00

When a target position is a position on the right side of the position "X2+A4 width/2", the coefficients are set as follows.

a1 to a4=0.00 b1 to b4=0.00 c1 to c4=0.00 d1 to d4=0.00

Similarly, when "extra right-head joining position" in FIG. 9B is set thereto, a recording head to be used is switched by making a position X2 as a left edge of the area A4 as a joining position. Setting examples of the coefficients a1 to a4, b1 to b4, c1 to c4, and d1 to d4 used for the calculation in step S5011 are described as follows.

a1 to a4=0.00 b1 to b4=0.00 c1 to c4=0.00 d1 to d4=1.00

Similarly, when "extra left-head joining position" in FIG. 9C is set thereto, a recording head to be used is switched by making a position X3 as a right edge of the area A4 as a joining position. Setting examples of the coefficients a1 to a4, b1 to b4, c1 to c4, and d1 to d4 used for the calculation in step S5011 are described as follows.

a1 to a4=1.00 b1 to b4=0.00 c1 to c4=0.00 d1 to d4=0.00

Figure 10A:
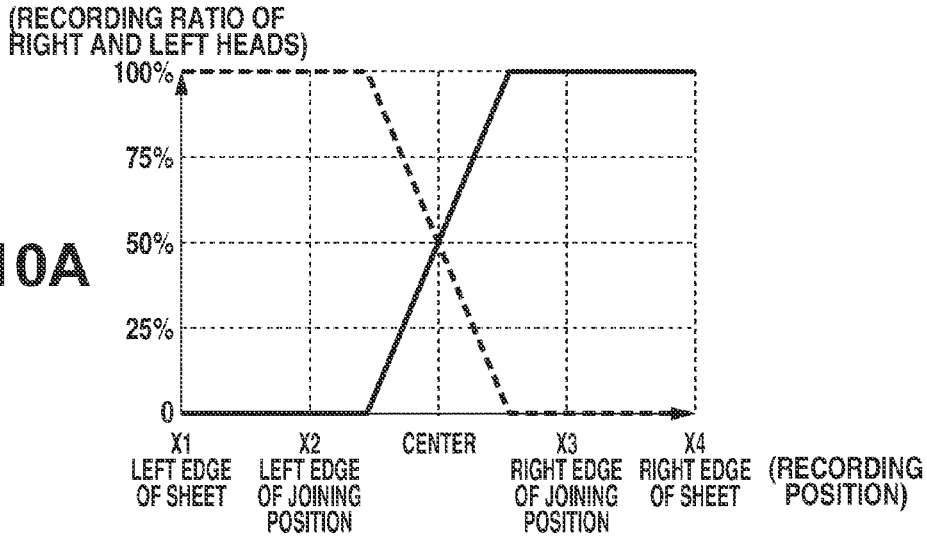
FIGS. 10A, 10B, and 10C are diagrams illustrating examples of joining processing according to one or more aspects of the present disclosure.
Figure 10B:
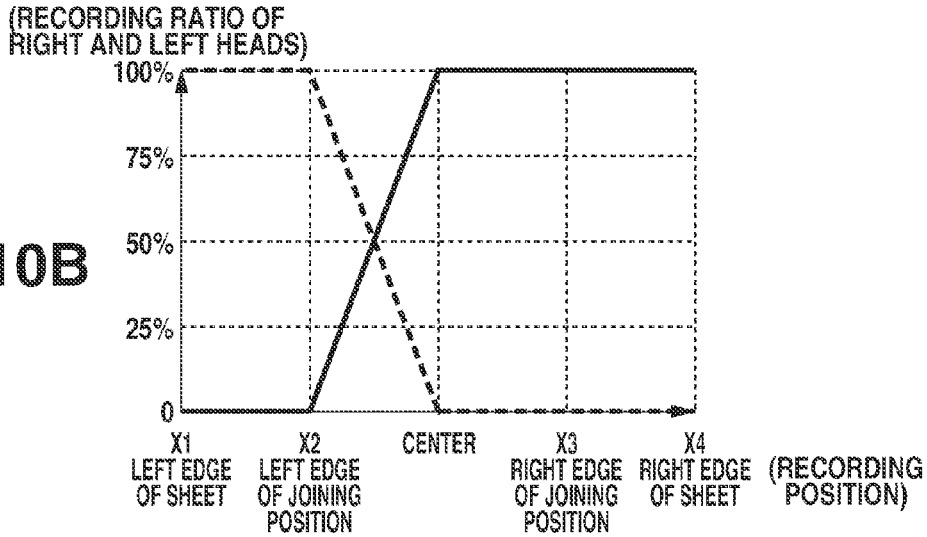
Figure 10C:
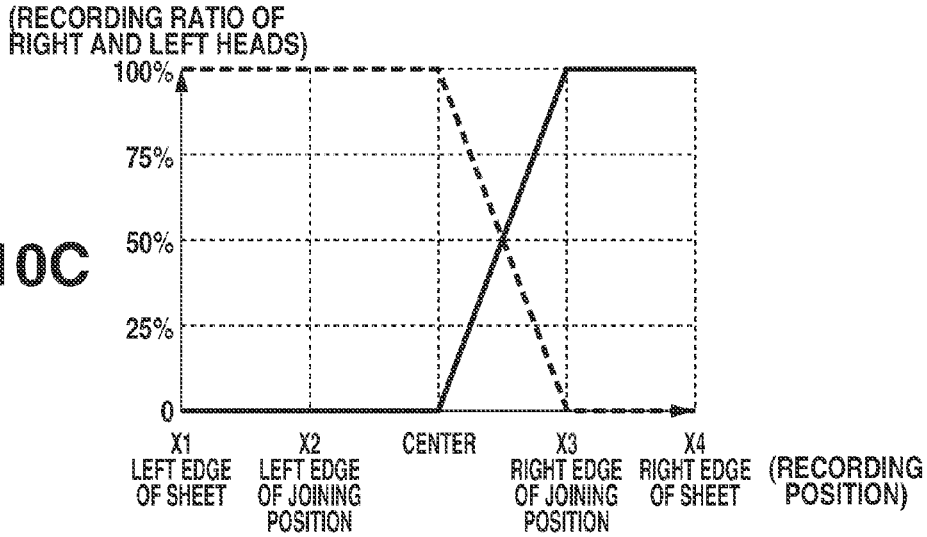

In FIGS. 10A to 10C, a part of the area A4 is set as an overlapping area where recording is executed by both of the recording heads 101L and 101R, and the ratio of using the recording heads 101L and 101R in the overlapping area is gradually changed. In the present exemplary embodiment, the overlapping area where joining processing is executed is an area having a half the width of the area A4. The ratio is gradually changed in the scanning direction so that the recording head 101L is used more than the recording head 101R in an area spanning from the center of the area A4 to a left edge of the overlapping area, i.e., the area closer to the edge portion of the area A3. Similarly, the ratio is gradually changed in the scanning direction so that the recording head 101R is used more than the recording head 101L in an area spanning from the center of the area A4 to a right edge of the overlapping area, i.e., the area closer to the edge portion of the area A5. FIG. 10A illustrates an example of "standard joining position", FIG. 10B illustrates an example of "extra right-head joining position", and FIG. 10C illustrates an example of "extra left-head joining position". The horizontal axis is similar to the horizontal axis described in FIGS. 8A to 8C and FIGS. 9A to 9C, and thus description thereof will be omitted.

When "standard joining position" in FIG. 10A is set thereto, the overlapping area where joining processing is executed by using both of the right and the left recording heads 101R and 101L is an area positioned at the center of the area A4, spanning from the position "X2+A4 width/4" to the position "X3−A4 width/4". Setting examples of the coefficients a1 to a4, b1 to b4, c1 to c4, and d1 to d4 used for the calculation in step S5011 are described as follows.

When a target position is a position on the left side of the position "X2+A4 width/4", the coefficients are set as follows.

a1 to a4=1.00 b1 to b4=0.00 c1 to c4=0.00 d1 to d4=0.00

When a target position is a position on the right side of the position "X2+A4 width/4" and on the left side of the position "X3−A4 width/4", the coefficients are set as follows.

$a1$ to $a4=(w-x)/w*(w-x)/w$ $b1$ to $b4=x/w*(w-x)/w$ $c1$ to $c4=x/w*x/w$ $d1$ to $d4=(w-x)/w*x/w$

Here, "w" represents a half the width (number of pixels) of the area A4, and "x" represents a pixel position (number of pixels) of a processing target pixel from the position "X2+A4 width/4". Accordingly, "x" is equal to 0 (x=0) at the position "X2+A4 width/4", and "x" is equal to "w" (x=w) at the position "X3−A4 width/4".

When a target position is a position on the right side of the position "X3−A4 width/4", the coefficients are set as follows.

a1 to a4=0.00 b1 to b4=0.00 c1 to c4=0.00 d1 to d4=1.00

Similarly, when "extra right-head joining position" in FIG. 10B is set thereto, the overlapping area where joining processing is executed by using both of the right and the left recording heads 101R and 101L is a left-half area spanning from the position X2 to the center of the area A4. Setting examples of the coefficients a1 to a4, b1 to b4, c1 to c4, and d1 to d4 used for the calculation in step S5011 are described as follows.

When a target position is a position on the left side of the position "X2+A4 width/2", the coefficients are set as follows.

$a1$ to $a4=(w-x)/w*(w-x)/w$ $b1$ to $b4=x/w*(w-x)/w$ $c1$ to $c4=x/w*x/w$ $d1$ to $d4=(w-x)/w*x/w$

Here, "w" represents a half the width (number of pixels) of the area A4, and "x" represents a pixel position (number of pixels) of a processing target pixel from the position X2. Accordingly, "x" is equal to 0 (x=0) at the position X2, and "x" is equal to "w" (x=w) at the position "X2+A4 width/2".

When a target position is a position on the right side of the position "X2+A4 width/2", the coefficients are set as follows.

a1 to a4=0.00 b1 to b4=0.00 c1 to c4=0.00 d1 to d4=1.00

Similarly, when "extra left-head joining position" in FIG. 10C is set thereto, the overlapping area where joining processing is executed by using both of the right and the left recording heads 101R and 101L is a right-half area spanning from the center of the area A4 to the position X3. Setting examples of the coefficients a1 to a4, b1 to b4, c1 to c4, and d1 to d4 used for the calculation in step S5011 are described as follows.

When a target position is a position on the left side of the position "X2+A4 width/2", the coefficients are set as follows.

a1 to a4=1.00 b1 to b4=0.00 c1 to c4=0.00 d1 to d4=0.00

When a target position is a position on the right side of the position "X2+A4 width/2", the coefficients are set as follows.

$a1$ to $a4=(w-x)/w*(w-x)/w$ $b1$ to $b4=x/w*(w-x)/w$ $c1$ to $c4=x/w*x/w$ $d1$ to $d4=(w-x)/w*x/w$

Here, "w" represents a half the width (number of pixels) of the area A4, and "x" represents a pixel position (number of pixels) of a processing target pixel from the position "X2+A4 width/2". Accordingly, "x" is equal to (x=0) at the position "X2+A4 width/2", and "x" is equal to "w" (x=w) at the position X3.

Here, the processing flow will be described with reference to FIG. 5 again. In step S5013*a*, the CPU 311 executes quantization processing of converting respective pieces of data LKout, LCout, LMout, and LYout indicating the allocation amounts of ink of the recording head 101L into dot data indicating presence or absence of dot to be actually recorded. The presence or absence of dot indicates whether the ink is to be discharged or not to be discharged from respective nozzles of the recording head 101L. Similarly, in step S5013*b*, the CPU 311 executes quantization processing of converting respective pieces of data RKout, RCout, RMout, and RYout indicating the allocation amounts of ink of the recording head 101R into dot data indicating presence or absence of dot to be actually recorded. The presence or absence of dot indicates whether the ink is to be discharged or not to be discharged from respective nozzles of the recording head 101R. In addition, the quantization processing may be executed through any known method such as an error diffusion method or a dither matrix method. When the quantized dot data is transmitted to the recording heads 101L and 101R, and dot data for the recording heads 101L and 101R to execute one time of scanning is prepared, actual recording of an image is executed on the recording sheet 106 by the recording heads 101L and 101R.

In step S5014*a*, based on the dot data quantized for the recording head 101L, accumulation processing is executed by counting the number of dots through the following formula. In addition, a value Count_LK represents a recorded dot count of the black ink of the recording head 101L.

Dot_LK+Count_LK

Similarly, in step S5014*b*, based on the dot data quantized for the recording head 101R, accumulation processing is executed by counting the number of dots through the following formula. In addition, "Count_RK" represents a recorded dot count of the black ink of the recording head 101R.

Dot_*RK*+=Count_*RK*

In the present exemplary embodiment, for the sake of simplicity, consumption of ink discharged for the purpose other than the purpose of recording an image on the recording sheet 106 is not taken into consideration. However, by taking consumption of ink discharged for the purpose other than image recording, e.g., a so-called preliminary discharge in which ink is discharged to the outside of the recording medium, into consideration, precision for estimating the residual amount of ink can be further improved.

In step S5015, the CPU 311 judges whether processing has been completed with respect to all of the pixels in the image data of documents to be recorded. When a judgement result is "YES" (YES in step S5015), this printing flow is ended. Information about the dot counts Dot_LK and Dot_RK accumulated and calculated up to this time is stored in the ROM 313 and used for the printing flow when a job is input thereto next time. When a judgement result in step S5015 is "NO" (NO in step S5015), the processing returns to step S5010, so that processing of subsequent documents is executed. Thereafter, the processing in steps S5010 to S5015 is repeatedly executed until all of the documents are processed.

As described above, the residual amount of ink is estimated by adding up the consumption amount of the black ink of each of the recording heads 101L and 101R. Then, according to a difference between the residual amounts of the black ink of the recording heads 101R and 101L, a joining position of the right and the left recording heads 101R and 101L is determined so as to cause the ink having a relatively greater residual amount to be used more. With this configuration, a difference between the residual amounts of the black ink in the ink tanks corresponding to the recording heads 101R and 101L can be reduced. By executing the above-described control, it is possible to increase an amount of recording executed by using the black ink tank corresponding to the recording head 101L and the black ink tank corresponding to the recording head 101R.

Further, in the present exemplary embodiment, although the black ink that is primarily used is taken as a judgement target, judgement may be executed by using the ink of any color instead of the black ink. Further, a difference between the residual amounts of the right and the left ink tanks may be detected at each color with respect to all of the ink colors, and a position where joining processing is executed may be changed when a maximum difference value is greater than a predetermined amount.

In a method described in the first exemplary embodiment, a difference between residual amounts has been reduced by controlling the joining processing based on the residual amounts of the black ink of the recording heads 101L and 101R. In a method described in a second exemplary embodiment, the joining processing is executed based on all of the residual amounts of the black ink and the color inks of the recording heads 101L and 101R.

Figure 6:
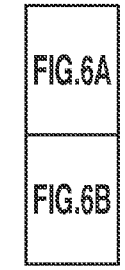
FIGS. 6, 6A, and 6B are a flowchart illustrating processing of a second exemplary embodiment according to one or more aspects of the present disclosure.
Figure 6A:
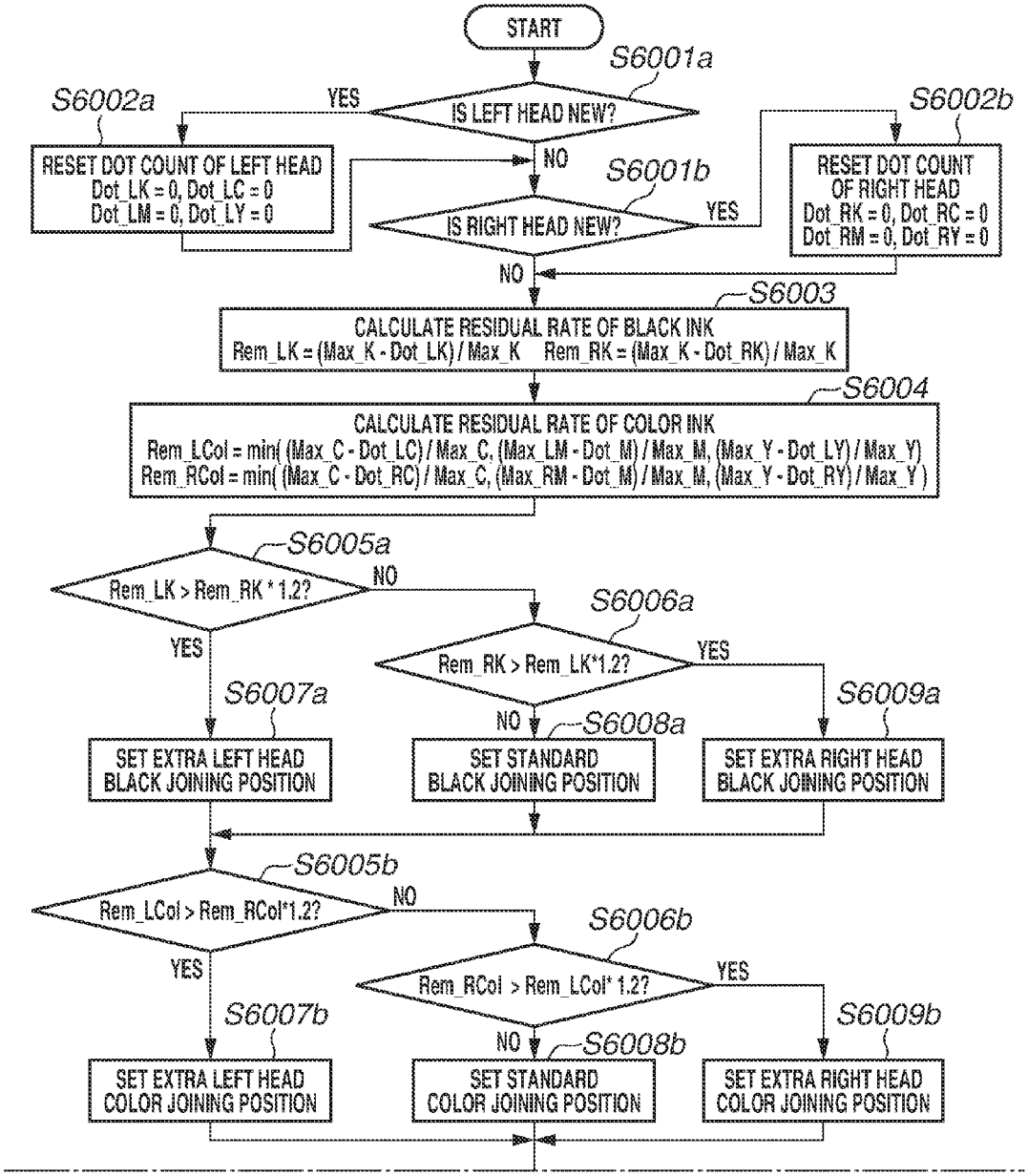
Figure 6B:
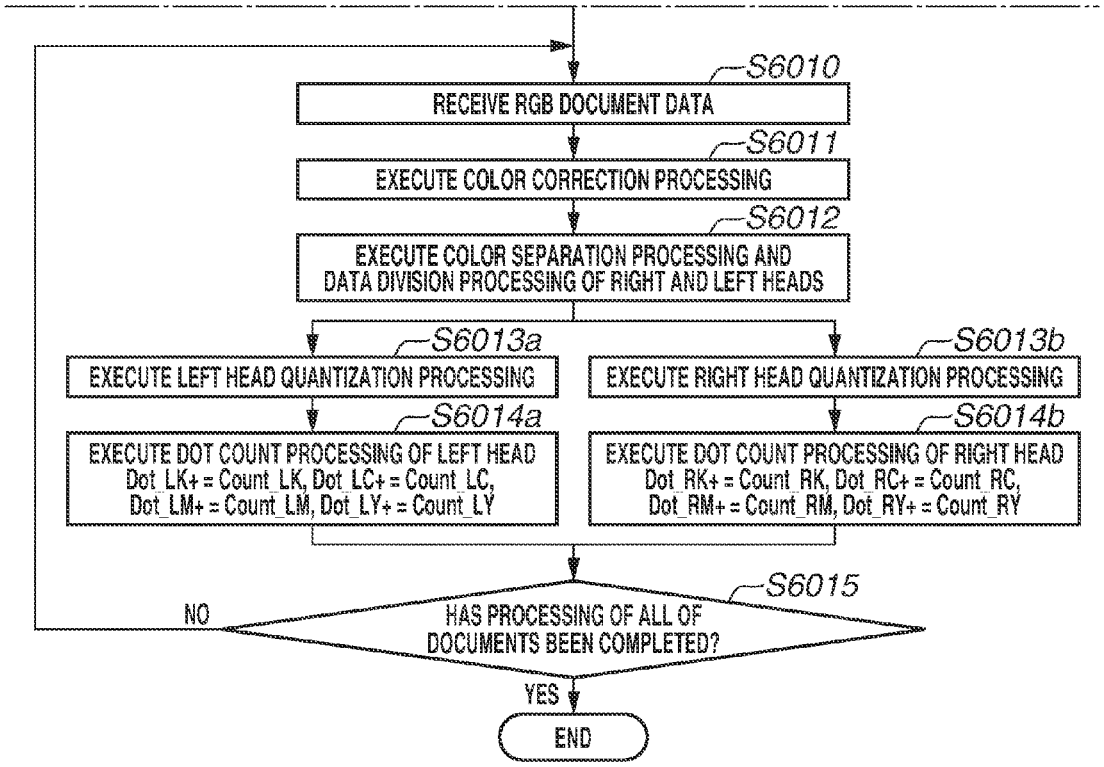

FIGS. 6A and 6B are a processing flow according to the present exemplary embodiment. When a printing flow is started, in step S6001*a*, the CPU 311 judges whether the recording head 101L that is being used is new. If the CPU 311 judges that the recording head 101L is new (YES in step S6001*a*), the processing proceeds to step S6002*a*. In step S6002*a*, the CPU 311 resets a number of times of discharge (i.e., dot count) counted at the recording head 101L, and the processing proceeds to step S6001*b*. In step S6001*a*, if the CPU 311 judges that the recording head 101L is not new but has been used before (NO in step S6001*a*), the processing simply proceeds to step S6001*b* because the discharged ink dot count up to this time is carried over.

In step S6001*b*, the CPU 311 judges whether the recording head 101R that is being used is new. If the CPU 311 judges that the recording head 101R is new (YES in step S6001*b*), the processing proceeds to step S6002*b*. In step S6002*b*, the CPU 311 resets a number of times of discharge (i.e., dot count) counted at the recording head 101R, and the processing proceeds to step S6003. In step S6001*b*, if the CPU 311 judges that the recording head 101R is not new but has been used before (NO in step S6001*b*), the processing simply proceeds to step S6003 because the discharged ink dot count up to this time is carried over. The processing in step S6003 is similar to the processing in step S5003 in FIG. 5, so that description thereof will be omitted.

In step S6004, residual rates of the color inks are calculated.

$$\text{Rem_}L\text{Col}=\min((\text{Max_}C-\text{Dot_}LC)/\text{Max_}C,\ (\text{Max_}M-\text{Dot_}LM)/\text{Max_}M,\ (\text{Max_}Y-\text{Dot_}LY)/\text{Max_}Y)$$

$$\text{Rem_}R\text{Col}=\min((\text{Max_}C-\text{Dot_}RC)/\text{Max_}C,\ (\text{Max_}M-\text{Dot_}RM)/\text{Max_}M,\ (\text{Max_}Y-\text{Dot_}RY)/\text{Max_}Y)$$

Here, a value Rem_LCol is a residual rate of the color inks at the recording head 101L, and a full state is represented by 1.0 whereas an empty state is represented by 0.0. Similarly, a value Rem_RCol is a residual rate of the color inks at the recording head 101R, and a full state is represented by 1.0 whereas an empty state is represented by 0.0.

Each of constant numbers Max_C, Max_M, and Max_Y represents a maximum number of pixels recordable at each color when an ink tank of cyan, magenta, or yellow is full (i.e., a maximum dischargeable ink dot count), and a value thereof is determined according to a size of the ink tank and a discharge amount of the recording head. In the present exemplary embodiment, the constant numbers Max_C, Max_M, and Max_Y are common to the recording heads 101L and 101R.

Each of values Dot_LC, Dot_LM, and Dot_LY represents a dot count of each ink color discharged by the time of judgement after a new recording head 101L formed integrally with the ink tanks is attached. In the present exemplary embodiment, a value Rem_LCol is a minimum value of the residual rates of the ink of cyan, magenta, and yellow, which is a residual rate of the ink color having the least residual amount. Similarly, each of values Dot_RC, Dot_RM, and Dot_RY represents a dot count of each ink color discharged by the time of judgement after a new recording head 101R formed integrally with the ink tanks is attached. In the present exemplary embodiment, a value Rem_RCol is a minimum value of the residual rates of the ink of cyan, magenta, and yellow, which is a residual rate of the ink color having the least residual amount.

Although description of steps S6005*a* to S6009*a* will be omitted because processing thereof is similar to the processing in steps S5005*a* to S5009*a* in FIG. 5, the CPU 311 sets "black joining position information" indicating a position of the overlapping area where both of the recording heads 101L and 101R are used for actually executing recording. After ending the processing in steps S6005*a* to S6009*a*, the processing proceeds to step S6005*b*. Processing in steps S6005*b* to S6009*b* is similar to the processing in steps S6005*a* to S6009*a*. Here, a residual rate of the ink having the least residual amount (Rem_LCol) from among the color inks corresponding to the recording head 101L and a residual rate of the ink having the least residual amount (Rem_RCol) from among the color inks corresponding to the recording head 101R are compared to each other. Then, the CPU 311 judges whether the difference is greater than a predetermined amount, and sets "color joining position information" indicating a position of the overlapping area where both of the recording heads 101L and 101R are used for actually executing recording. In the present exemplary embodiment, the CPU 311 judges whether a value of one residual rate is greater than a value 1.2 times as much as a value of another residual rate. Here, the above comparison is not always made between the inks of the same color.

The following judgement formulas are used for respective processing steps.

Step S6005*b*: Rem_LCol>Rem_RCol*1.2

Step S6006*b*: Rem_RCol>Rem_LCol*1.2

If the processing proceeds to step S6007*b* (YES in step S6005*b*), this indicates that the minimum residual amount of the color ink from among the color inks of the recording head 101R is considerably less than the minimum residual amount of the color ink from among the color inks of the recording head 101L. At this time, the CPU 311 sets the joining position of the recording heads 101L and 101R as "joining position where the recording head 101L is used more".

Similarly, if the processing proceeds to step S6009*b* (YES in step S6006*b*), this indicates that the minimum residual amount of the color ink from among the color inks of the recording head 101L is considerably less than the minimum residual amount of the color ink from among the color inks of the recording head 101R. At this time, the CPU 311 sets the joining position of the recording heads 101L and 101R as "joining position where the recording head 101R is used more".

If the processing proceeds to step S6008*b* (NO in step S6006*b*), this indicates that there is not so much difference between the minimum residual amount of the color ink from among the color inks of the recording head 101L and the minimum residual amount of the color ink from among the color inks of the recording head 101R. At this time, the CPU 311 sets the joining position of the recording heads 101L and 101R as "standard joining position".

After ending the processing in steps S6005*b* to S6009*b*, the processing proceeds to step S6010. Processing in steps S6010 and S6011 is similar to the processing in steps S5010 and S5011 in FIG. 5, so that description thereof will be omitted.

In step S6012, different from the processing in step S5012, the CPU 311 sets a joining position of the black ink and a joining position of the color ink. Accordingly, "black joining position information" set in steps S6007*a* to S6009*a* is used when the coefficients a1, b1, c1, and d1 used for black ink calculation are calculated. Then, "color joining position information" set in steps S6007*b* to S6009*b* is used when the coefficients a2 to a4, b2 to b4, c2 to c4, and d2 to d4 used for color ink calculation are calculated.

Processing in steps S6013*a* and S6013*b* is similar to the processing in steps S5013*a* and S5013*b* in FIG. 5, so that description thereof is omitted.

In step S6014*a*, based on the dot data quantized for the recording head 101L, accumulation processing is executed by counting the number of dots through the following formulas.

$$Dot_LK += Count_LK$$

$$Dot_LC += Count_LC$$

$$Dot_LM += Count_LM$$

$$Dot_LY += Count_LY$$

Here, each of "Count_LK", "Count_LC", "Count_LM", and "Count_LY" represents a recorded dot count of each color ink of the recording head 101L.

Similarly, in step S6014*b*, based on the dot data quantized for the recording head 101R, accumulation processing is executed by counting the number of dots through the following formulas.

$$Dot_RK += Count_RK$$

$$Dot_RC += Count_RC$$

$$Dot_RM += Count_RM$$

$$Dot_RY += Count_RY$$

Here, each of "Count_RK", "Count_RC", "Count_RM", and "Count_RY" represents a recorded dot count of each color ink of the recording head 101R.

In step S6015, the CPU 311 judges whether processing has been completed with respect to all of pixels of the image data to be recorded. If a judgement result is "YES"(YES in step S6015), this processing flow is ended. Information about the dot counts Dot_LK, Dot_LC, Dot_LM, Dot_LY and information about the dot counts Dot_RK, Dot_RC, Dot_RM, and Dot_RY accumulated and calculated up to this time are stored in the ROM 313 and used when a printing command of the next document is input thereto. When a judgement result in step S6015 is "NO" (NO in step S6015), the processing returns to step S6010, so that processing of subsequent documents is executed. Thereafter, the processing in steps S6010 to S6015 is repeatedly executed until the last pixel is processed.

As described above, a consumption amount of ink of the recording head 101L or 101R is added up at each color, and a residual amount of corresponding ink within the ink tank is estimated. If it is determined that a difference between the residual amounts of the ink within the right and the left ink tanks is large, and that unsymmetrical reduction arises in a certain color ink, joining processing is executed so as to cause the ink having the relatively greater residual amount to be used more. With this processing, a difference between the residual amounts of the ink within the ink tanks can be reduced by approximating the consumption rate of the ink color having a difference in the residual amounts, and an amount of recording executed by using the ink tanks can be increased.

Further, in the present exemplary embodiment, although three color inks are collectively controlled by using a minimum value of the residual rates of the three color inks, an effect of the present disclosure is not limited to the above-described combination, and each of the color inks may be independently controlled. By executing the above-described control, an amount of recording executable by using the ink tanks corresponding to the recording head 101L and the ink tanks corresponding to the recording head 101R can be increased. Further, an ink tank of at least one chromatic color ink from among the inks of cyan, magenta, and yellow may be mounted thereon, and the ink colors are not limited to the above-described colors.

Further, in the present exemplary embodiment, an ink having the smallest residual amount from among three color inks corresponding to each of the right and the left recording heads 101R and 101L is specified at each of the right and the left recording heads 101R and 101L, and the joining position is set by comparing the residual amounts of the specified inks. However, the exemplary embodiment is not limited thereto, and a difference between the residual amounts of the ink of the right and the left recording heads 101L and 101R may be judged at each ink color, and the joining position may be set so as to cause the ink having a greater residual amount to be used more when the difference between the residual amounts is greater than a predetermined amount.

Other Embodiments

Embodiment(s) of the present disclosure can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD™), a flash memory device, a memory card, and the like.

<The Other Exemplary Embodiments>

In the above-described exemplary embodiment, although three examples are described as candidates of the joining position set thereto, the joining position may be selected from more than three candidates. In this case, the consumption ratio of the inks of the right and the left recording heads 101L and 101R can be more precisely controlled. Further, in the processing flow of FIG. 5 or 6, a joining position is set by a job unit, and the same joining position is continuously used until the job is ended in step S5015 or S6015. However, the joining position may be set at a timing of any unit such as a job unit, a page unit, or a unit of an object in a page, and each of the above units has a different advantage. When the joining position is set by a job unit, a recording amount can be increased while uniformly maintaining the recording quality of a plurality of pages of documents when a plurality of pages of similar documents are included in one job. When the joining position is set by a page unit, although there arises a difference in recording quality between pages because of a difference in joining positions, recording quality can be uniformly maintained at each page while reducing a possibility of ink shortage arising in the course of executing a job. Further, when the joining position is set by a unit of an object in a page, although there arises a difference in recording quality between the objects included in the page because of a difference in joining positions, a possibility of ink shortage arising in the page is reduced, and recording can be executed even in a state just before ink shortage. As described above, various settings are possible with respect to the timing of setting the joining position, and the timing can be set as appropriate through manual setting performed by the user or automatic setting according to a state of the printer main unit.

Further, an exemplary embodiment in which the processing illustrated in FIGS. 5 and 6, i.e., processing of acquiring information about a residual amount and processing of determining joining processing by using the acquired information, are executed by the printer 100 has been described. However, the above-described processing may be executed by the host PC 300, or the processing may be shared and executed by the host PC 300 and the printer 100.

Further, in the above-described exemplary embodiment, a configuration in which ink tanks of a plurality of colors of black, cyan, magenta, and yellow are provided integrally has been described. However, the present disclosure is applicable to a configuration in which ink tanks of respective colors are separately provided or a configuration in which only a part of the ink tanks is integrally provided. Further, in the above-described exemplary embodiment, a recording chip including recording elements and ink tanks are integrally formed on a recording head, and the recording head is attachable to or detachable from a recording apparatus. However, the present disclosure is not limited to the above configuration, and only ink tanks may be replaced by being detached from the recording apparatus. In this case, in steps S5001*a* and S5001*b* in FIG. 5 or in steps S6001*a* and S6001*b* in FIG. 6A, the CPU 311 may determine whether an ink tank is new instead of determining whether the recording head is new, or may determine whether an ink tank is full. An effect of the present disclosure becomes noticeable when a recording chip and ink tanks are integrally configured because the entire recording head including the recording chip has to be replaced in addition to the ink tanks in a case where ink of any one of the colors is consumed. Further, the right and the left recording heads may be separately or integrally formed, and the right and the left recording chips may be integrally formed. In this case, the recording elements of the ink of the same color for executing recording on the areas A1 and A2 may be separated from each other by a predetermined distance corresponding to a distance between the positions X1 and X2 in the X-direction in FIG. 2. This predetermined distance may be a distance at which the right and the left recording heads executes recording by sharing the areas arranged in the X-direction of the recording medium, and the distance can be determined as appropriate according to a configuration of the recording apparatus or a size of the recording medium.

Further, respective count values of dot counts of ink discharged from the recording heads 101L and 101R may be retained by the printer 100. Furthermore, the count values may be retained by replaceable ink tanks or a recording head formed integrally with ink tanks. When the count values are retained by the replaceable ink tanks or the recording head, processing steps of judging whether the recording head is new, described in steps S5001*a* and S5001*b* of FIG. 5 or steps S6001*a* and S6001*b* of FIG. 6A may be omitted. In addition, when the count values are retained by the ink tanks or the recording head configured integrally with ink tanks, the effect of the present disclosure can be also acquired when a partly-used recording head is attached to a different recording apparatus.

Further, in the above-described exemplary embodiment, although a method of estimating the residual amount by counting a recorded dot count based on recording data of quantized binary values has been used, a method of acquiring the residual amount is not limited thereto. For example, a method of detecting a residual amount by using a sensor or another method may be used as long as the residual amount of ink within the ink tank can be estimated thereby.

Through the above-described configuration, in a recording apparatus that uses a plurality of recording units to share an area in the scanning direction to execute recording, it is possible to increase an amount of recording executable by using a plurality of colors of ink tanks corresponding to the respective recording units.

While the present disclosure has been described with reference to exemplary embodiments, the scope of the following claims are to be accorded the broadest interpretation so as to encompass all such modifications and equivalent structures and functions.

This application claims the benefit of Japanese Patent Application No. 2016-220856, filed Nov. 11, 2016, which is hereby incorporated by reference herein in its entirety.

What is claimed is:

1. A recording apparatus which executes recording on a first area of a recording medium conveyed in a conveyance direction by using a first recording unit having a group of recording elements for discharging ink stored in a first tank and executes recording on a second area of the recording medium different from the first area in a scanning direction by using a second recording unit having a group of recording elements for discharging ink stored in a second tank, which is arranged separately from the first recording unit by a predetermined distance in the scanning direction intersecting with the conveyance direction, the recording apparatus comprising:

an acquisition unit configured to acquire first information about a residual amount of ink within the first tank and second information about a residual amount of ink within the second tank;

a determination unit configured to determine the first area and the second area in the scanning direction based on the first information and the second information, wherein the length of the first area and the length of the second area in the scanning direction are according to a difference of the residual amount of ink within the first tank indicated by the first information and the residual amount of ink within the second tank indicated by the second information; and a control unit configured to control recording of an image based on a determination made by the determination unit.

2. The recording apparatus according to claim 1, wherein, in a case where the difference is greater than a predetermined amount, the determination unit determines the first area and the second area so as to cause ink within a tank having a greater residual amount of ink to be used more from among the first tank and the second tank.

3. The recording apparatus according to claim 2, wherein the determination unit determines a length of the first area in the scanning direction so as to be longer than a length of the second area in the scanning direction in a case where the residual amount of ink within the first tank is greater than the residual amount of ink within the second tank while a difference between the two residual amounts is greater than a predetermined amount, and determines a length of the second area in the scanning direction so as to be longer than a length of the first area in the scanning direction in a case where the residual amount of ink within the second tank is greater than the residual amount of ink within the first tank while a difference between the two residual amounts is greater than a predetermined amount.

4. A recording apparatus which executes recording on a first area of a recording medium conveyed in a conveyance direction by using a first recording unit having a group of recording elements for discharging ink stored in a first tank and executes recording on a second area of the recording medium different from the first area in a scanning direction by using a second recording unit having a group of recording elements for discharging ink stored in a second tank, which is arranged separately from the first recording unit by a predetermined distance in the scanning direction intersecting with the conveyance direction, the recording apparatus comprising:

an acquisition unit configured to acquire first information about a residual amount of ink within the first tank and second information about a residual amount of ink within the second tank;

a determination unit configured to determine the first area and the second area in the scanning direction based on a ratio of the residual amount indicated by the first information and the residual amount indicated by the second information; and a control unit configured to control recording of an image based on a determination made by the determination unit.

5. The recording apparatus according to claim 1, wherein recording is executed on the first area by using the first recording unit without using the second recording unit, and recording is executed on the second area by using the second recording unit without using the first recording unit, so that the first area and the second area do not overlap with each other.

6. The recording apparatus according to claim 1, wherein the first area includes an area where recording is executed by using the first recording unit without using the second recording unit and an overlapping area where recording is executed by using both of the first recording unit and the second recording unit, and the second area includes the overlapping area and an area where recording is executed by using the second recording unit without using the first recording unit.

7. The recording apparatus according to claim 6, wherein the control unit controls the first recording unit and the second recording unit to discharge ink of a same amount in the overlapping area.

8. The recording apparatus according to claim 6, wherein the control unit controls an amount of ink discharged from the first recording unit to be greater than an amount of ink discharged from the second recording unit in the overlapping area closer to an edge portion of the first area to execute recording, and controls an amount of ink discharged from the second recording unit to be greater than an amount of ink discharged from the first recording unit in the overlapping area closer to an edge portion of the second area to execute recording.

9. The recording apparatus according to claim 1 further comprising an input unit for receiving a job as a recording instruction of an image, wherein the acquisition unit acquires the first information and the second information based on an input of the job.

10. The recording apparatus according to claim 9, wherein, in a case where the job includes a plurality of pages of documents, the control unit sets the first area and the second area in the scanning direction to be constant when the plurality of pages of documents are recorded.

11. The recording apparatus according to claim 1, wherein the first tank and the second tank store an achromatic ink, and the first information and the second information are information about a residual amount of the achromatic ink.

12. The recording apparatus according to claim 11, wherein the first tank and the second tank further store a chromatic ink.

13. The recording apparatus according to claim 12, wherein a color of the chromatic ink is at least any one of cyan, magenta, and yellow.

14. The recording apparatus according to claim 12, wherein the acquisition unit further acquires third information about a residual amount of the chromatic ink within the first tank and fourth information about a residual amount of the chromatic ink within the second tank, wherein the determination unit further determines the first area and the second area based on the third information and the fourth information, and wherein the length of the first area and the length of the second area in the scanning direction are according to a difference of the residual amount of chromatic ink within the first tank indicated by the third information and the residual amount of chromatic ink within the second tank indicated by the fourth information.

15. The recording apparatus according to claim 12, wherein each of the first tank and the second tank stores a plurality of color inks as the chromatic inks, and wherein the determination unit determines the first area and the second area based on (i) a difference between a residual amount based on the first information and a residual amount based on the second information, and (ii) a difference between a smallest residual amount of ink from among the plurality of chromatic color inks within the first tank and a smallest residual amount of ink from among the plurality of chromatic color inks within the second tank.

16. The recording apparatus according to claim 1, wherein the first information is information in which a number of times ink is discharged from the first recording unit is counted, and the second information is information in which a number of times ink is discharged from the second recording unit is counted.

17. The recording apparatus according to claim 1, wherein the first tank is detachably attached integrally with a chip on which recording elements of the first recording unit are mounted, and the second tank is detachably attached integrally with a chip on which recording elements of the second recording unit are mounted.

18. The recording apparatus according to claim 1, wherein the first tank is detachably attachable and formed separately from a chip on which the recording elements of the first recording unit are mounted, and the second tank is detachably attachable and formed separately from a chip on which the recording elements of the second recording unit are mounted.

19. The recording apparatus according to claim 18, wherein the chip on which the recording elements of the first recording unit are mounted and the chip on which the recording elements of the second recording unit are mounted are separately formed.

20. A recording method of executing recording on a first area of a recording medium conveyed in a conveyance direction by using a first recording unit having a group of recording elements for discharging ink stored in a first tank and executing recording on a second area of the recording medium different from the first area in a scanning direction by using a second recording unit having a group of recording elements for discharging ink stored in a second tank, which is arranged separately from the first recording unit by a predetermined distance in the scanning direction intersecting with the conveyance direction, the recording method comprising:

acquiring first information about a residual amount of ink within the first tank and second information about a residual amount of ink within the second tank;

determining the first area and the second area in the scanning direction based on the first information and the second information, wherein the length of the first area and the length of the second area in the scanning direction are according to a difference of the residual amount of ink within the first tank indicated by the first information and the residual amount of ink within the second tank indicated by the second information; and recording an image based on a determination made by the determining.

21. The recording apparatus according to claim 4, wherein, in a case where the ratio is greater than a predetermined amount, the determination unit determines the first area and the second area so as to cause ink within a tank having a greater residual amount of ink to be used more from among the first tank and the second tank.

* * * * *